US011091971B2

(12) United States Patent
Oser et al.

(10) Patent No.: US 11,091,971 B2
(45) Date of Patent: Aug. 17, 2021

(54) MODULAR ELECTRO-HYDRAULIC DOWNHOLE CONTROL SYSTEM

(71) Applicant: Halliburton Energy Services, Inc., Houston, TX (US)

(72) Inventors: Michael Stephen Oser, Frisco, TX (US); Robert Howard, Duncan, OK (US); Desmond Jones, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/628,539

(22) PCT Filed: Aug. 25, 2017

(86) PCT No.: PCT/US2017/048740
§ 371 (c)(1),
(2) Date: Jan. 3, 2020

(87) PCT Pub. No.: WO2019/040082
PCT Pub. Date: Feb. 28, 2019

(65) Prior Publication Data

US 2020/0217157 A1 Jul. 9, 2020

(51) Int. Cl.
*E21B 23/04* (2006.01)
*E21B 34/10* (2006.01)
(Continued)

(52) U.S. Cl.
CPC ..... *E21B 23/04* (2013.01); *E21B 34/10* (2013.01); *E21B 34/14* (2013.01);
(Continued)

(58) Field of Classification Search
CPC ..... E21B 23/0421; E21B 23/04; E21B 34/10
See application file for complete search history.

(56) References Cited

U.S. PATENT DOCUMENTS 5,251,703 A 10/1993 Skinner
7,954,522 B2 6/2011 Yang
(Continued)

FOREIGN PATENT DOCUMENTS

WO 2016039728 3/2016
WO 2016171664 10/2016

OTHER PUBLICATIONS

ISRWO International Search Report and Written Opinion for PCT/US2017/048740 dated May 24, 2018.

*Primary Examiner* — Cathleen R Hutchins
(74) *Attorney, Agent, or Firm* — Thomas Rooney; C. Tumey Law Group PLLC

(57) ABSTRACT

A downhole tool includes a hydraulically operated actuation device to actuate the downhole tool and a control system that regulates flow of hydraulic fluid to the actuation device. The control system includes a pilot module and a power module. The power module has a first solenoid valve and a second solenoid valve fluidly coupled to a pressure source and a fluid return. The power module is fluidly coupled to the actuation device at an output line and a power line. A first power module check valve is arranged in the power line, a second power module check valve is arranged in a control pressure return line fluidly coupled to the fluid return, a first input communicates with the first solenoid valve, and a second input communicates with the second solenoid valve. A pilot-operated check valve is actuatable in response to a pilot signal to drain hydraulic fluid from the power module.

17 Claims, 6 Drawing Sheets

(51) Int. Cl.
*E21B 34/14* (2006.01)
*F15B 13/043* (2006.01)

(52) U.S. Cl.
CPC ..... *E21B 2200/04* (2020.05); *E21B 2200/06* (2020.05); *F15B 13/0431* (2013.01); *F15B 2211/30505* (2013.01); *F15B 2211/329* (2013.01); *F15B 2211/6355* (2013.01)

(56) References Cited

U.S. PATENT DOCUMENTS

| | | | | |
|---|---|---|---|---|
| 9,631,455 | B2 | 4/2017 | Geiger et al. | |
| 2006/0254763 | A1* | 11/2006 | Tips ..... | E21B 34/16 166/65.1 |
| 2011/0284241 | A1 | 11/2011 | Mandrou et al. | |
| 2012/0067593 | A1 | 3/2012 | Powell et al. | |

* cited by examiner

MODULAR ELECTRO-HYDRAULIC DOWNHOLE CONTROL SYSTEM

BACKGROUND

Technology improvements have made it possible to incorporate more functionality in tools used downhole in oil and gas wells. One technological improvement is the development of coiled tubing conveyed communications and power transmission. Using coiled tubing to convey communication and power transmission downhole reduces or entirely eliminates dependence on battery power, which has a finite life span. Coiled tubing conveyed communication and power transmission also allows control and/or operation of downhole devices (tools) from a well surface location in real-time.

With such available technology, it becomes more practical and advantageous to design downhole tools and devices that are operated by solenoid powered directional fluid valves.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to operation of downhole tools in the oil and gas industry and, more particularly, to solenoid powered and/or operated hydraulic circuits that deliver hydraulic power to downhole tools for operation.

The embodiments describe herein use electro-hydraulic power and control technology to operate an array of actuation devices commonly used in downhole tools, or any other devices that can utilize the same control methods described herein. The result is set of modular pilot and power modules providing hydraulic circuits that can be used individually or in combination. Solenoid valves included in the presently described pilot modules may comprise two-way and three-way solenoid valves, thereby facilitating unique two-way and/or four-way pilot modules that can be used to operate both small and large hydraulically operated downhole tools. The pilot modules can be combined with suitable power modules to use electro-hydraulic power and control technology to operate the actuation devices used to operate (actuate) downhole tools. Combining the unique pilot modules described herein with a function-specific power module provides tremendous simplicity of design yet robust capability to power and control practically any fluid-operated downhole tool. In addition, the latching and isolation features of the presently described pilot and power modules create substantial power demand reductions for both electrical and hydraulic power.

Figure 1:
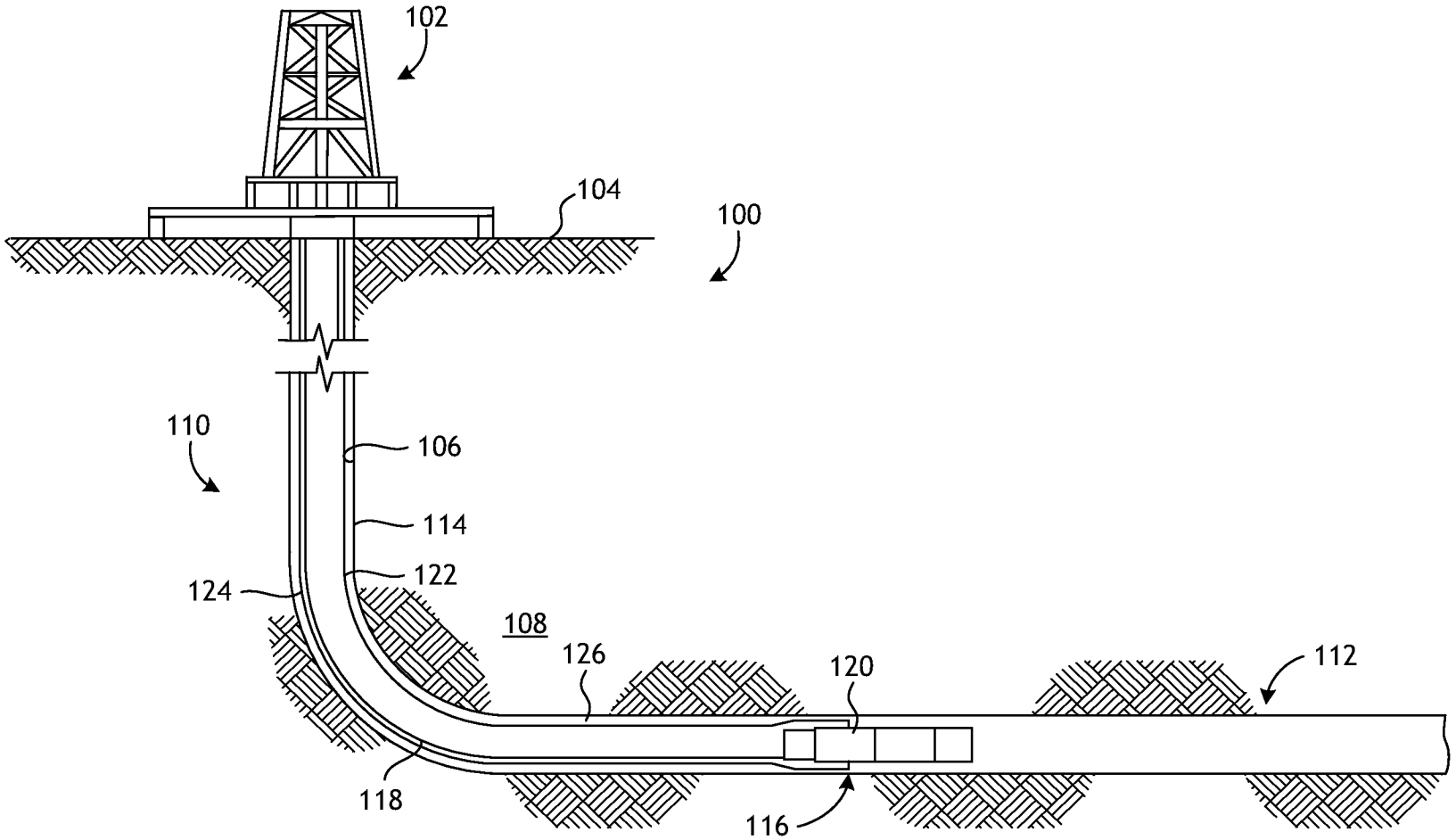
FIG. 1 is a schematic diagram of a well system that may employ one or more principles of the present disclosure.

FIG. 1 is a schematic diagram of a well system 100 that may employ one or more principles of the present disclosure, according to one or more embodiments. As illustrated, the well system 100 may include a service rig 102 positioned on the Earth's surface 104 and extending over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any offshore, sea-based, or sub-sea application where the service rig 102 may be a floating platform, a semi-submersible platform, or a subsurface wellhead installation as generally known in the art.

The wellbore 106 may be drilled into the subterranean formation 108 using any suitable drilling technique. In some embodiments, as illustrated, the wellbore 106 may extend in a substantially vertical direction away from the earth's surface 104 over a vertical wellbore portion 110 and at some point deviate and transition into a substantially horizontal wellbore portion 112. In other embodiments, however, the wellbore 106 may only include the vertical wellbore portion 110. In some embodiments, the wellbore 106 may be completed by cementing a casing string 114 within the wellbore 106 along all or a portion thereof. In other embodiments, however, the casing string 114 may be omitted from all or a portion of the wellbore 106. Accordingly, the principles of the present disclosure may equally apply to "open-hole" or uncased wellbore environments.

The system 100 may further include a downhole tool 116 conveyed into the wellbore 106 on a conveyance 118 that extends from the service rig 102. Even though FIG. 1 depicts the downhole tool 116 as being arranged within the horizontal portion 112 of the wellbore 106, the embodiments described herein are equally applicable for use in portions of the wellbore 106 that are vertical, deviated, or otherwise slanted. The downhole tool 116 may comprise any of a variety of hydraulically powered or hydraulically actuated downhole tools. Example downhole tools 116 include, but are not limited to, an inflatable packer element, a sliding sleeve, a flow control valve, a circulation valve, a perforating gun, a spool or sleeve valve, a ball valve, and any combination thereof. The conveyance 118 that delivers (conveys) the downhole tool 116 into the wellbore 106 may be, but is not limited to, coiled tubing, casing, drill pipe, sectional pipe, wireline, slickline, or the like.

The downhole tool 116 may include a control system 120 configured and otherwise programmed to operate the downhole tool 116 using electrically powered and/or operated hydraulic circuits. In some embodiments, command signals may be conveyed to the control system 120 via one or more control lines 122 that extend from the well surface 104 to the downhole tool 116, and hydraulic pressure may be conveyed to the downhole tool 116 via one or more hydraulic lines 124 also extending from the well surface 104. The hydraulic line(s) 124 may receive hydraulic fluid at the well surface 104 from a surface-located hydraulic source (not shown) and deliver pressurized fluid to the downhole tool 116 in order to actuate the downhole tool 116. While not shown, other hydraulic line(s) may be included in the well system 100 and coupled to the control system 120 to serve as a discharge line or return line that receives displaced hydraulic fluid resulting from actuation of the downhole tool 116. In other embodiments, however, the displaced hydraulic fluid may alternatively be discharged directly into the wellbore annulus 126 adjacent the downhole tool 116, without departing from the scope of the disclosure.

The control and hydraulic lines 122, 124 communicate with the control system 120 for purposes of causing the downhole tool 116 to perform an intended downhole function (operation). More specifically, the control system 120 may contain at least one pilot module containing electrically operated valves, such as solenoid valves, controlled by the control line(s) 122. While the present disclosure refers to solenoid valves, it will be understood that other electrically operated valves are contemplated. The pilot module can include a hydraulic circuit that controls the direction of fluid flow, for example at low flow rates. The pilot module can operate as a signal generator by creating pilot signals. The pilot signals can effect operation of a device directly (e.g., where the device can operate with the low flow rates) or indirectly (e.g., by signaling larger devices in a "relay" type fashion). Accordingly, a small hydraulic signal from a pilot module can control devices that manage significantly larger pressure and flow rates.

In some embodiments, the control line(s) 122 may include one or more fiber optic lines and one or more electrical conductors used to convey command signals and electrical power, respectively, to the control system 120 to trigger activation of the solenoid valves. In other embodiments, however, the fiber optic lines may be omitted and the command signals may alternatively be conveyed to the control system 120 via electrical conductors or by any known wired or wireless means. Moreover, in some embodiments, the electrical conductor(s) may be omitted and the solenoid valves may alternatively be powered using a downhole power source such as, but not limited to, batteries, fuel cells, a downhole power generator, or any combination thereof.

Upon receiving a command signal, at least one of the solenoid valves of the pilot module is energized (activated) to route hydraulic pressure supplied by the hydraulic line 124 to a desired location. In some embodiments, for example, the hydraulic pressure may be routed from the pilot module directly to an actuation device of the downhole tool 116 to cause actuation of the downhole tool 116. In other embodiments, however, the hydraulic pressure may be conveyed in the form of a pilot signal transmitted to a power module included in the control system 120 and communicably coupled to the pilot module. The power module can include a hydraulic circuit that can be operated based on pilot signals from a pilot module to control pressure and flow of hydraulic fluid. The pressure and flow controlled by the power module can be much larger than the pressure and flow of the pilot signal generated by the pilot module. The power module may include one or more check valves used for pressure isolation and one or more directional control valves that may be actuated (opened) in response to the pilot signal(s). The directional control valves are used to control hydraulic fluid flow to an actuation device of the downhole tool 116. The directional control valves can include or accompany a pilot-operated check valve. In accordance with some embodiments, pilot-operated check valves provide both a control and a positive lock function. Other types of directional control valves can include 2-way logic valves, 3 or 4-way spool valves, and other types of directional control valves that provide the same or similar functionality. While embodiments described herein include pilot-operated check valves, it will be understood that other types of directional control valves can be included or substituted.

Solenoid valves have been used in the past for operating small downhole devices and tools, such as well testing tools and devices. However, solenoid valves are not commonly used to operate larger downhole tools, such as inflatable packers, jetting tools, or large downhole valves required for services like pin-point stimulation and hydraulic re-fracturing operations. Rather, such tools are commonly operated using wellbore projectiles (i.e., ball drops), tubing jarring sequences, large downhole motors, etc. Using such devices and operations increases the complexity and cost of routine downhole operations.

According to embodiments of the present disclosure, solenoid valves included in the presently described pilot modules may comprise two-way and three-way solenoid valves, thereby facilitating unique two-way and/or four-way pilot modules that can be used to operate both small and large hydraulically operated downhole tools. In some cases, these novel pilot modules are combined with suitable power modules to use electro-hydraulic power and control technology to operate a variety of specific actuation devices commonly used to operate (actuate) downhole tools (e.g., the downhole tool 116). Combining the unique pilot modules described herein with a function-specific power module provides tremendous simplicity of design yet robust capability to power and control practically any fluid-operated downhole tool. In addition, the latching and isolation features of the presently described pilot and power modules create substantial power demand reductions for both electrical and hydraulic power.

Figure 2A:
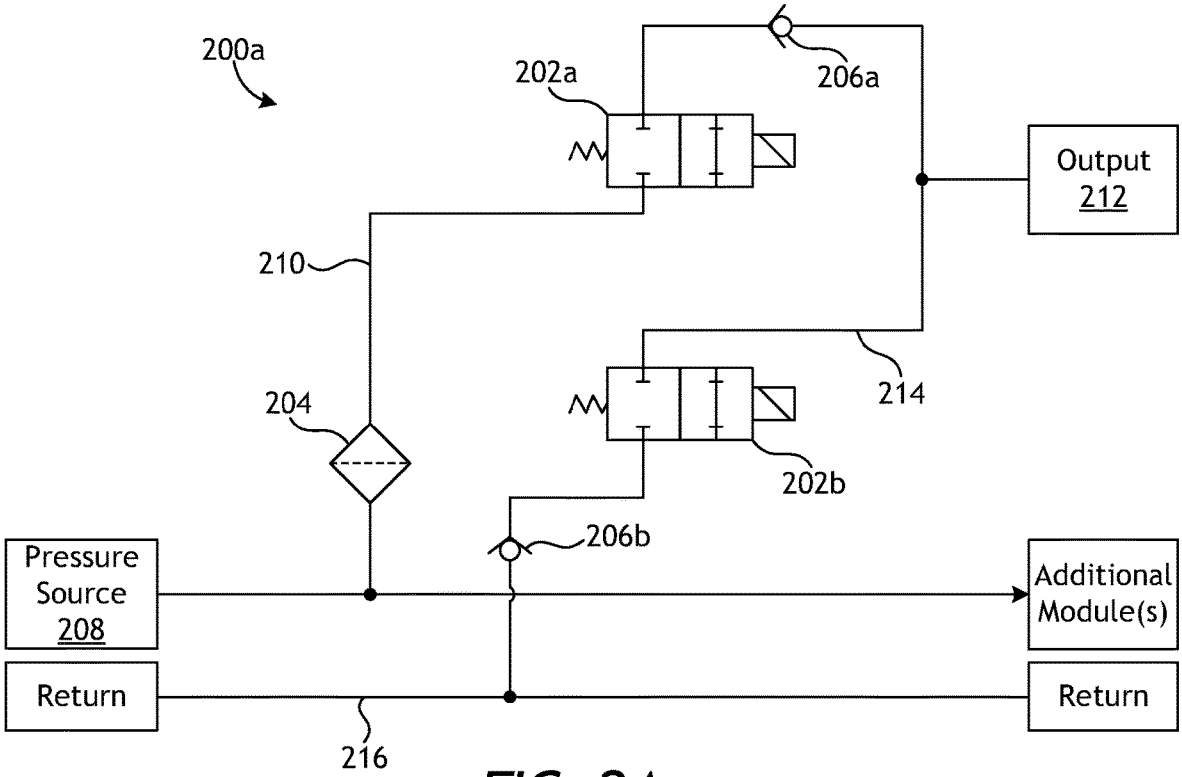
FIG. 2A is a schematic diagram of a first example pilot module.

FIG. 2A is a schematic diagram of a first example pilot module 200*a*, according to one or more embodiments. The first pilot module 200*a* may form part of the control system 120 of FIG. 1 and, therefore, may be used in controlling operation (actuation) of the downhole tool 116 (FIG. 1). The first pilot module 200*a* (and the other pilot modules described herein) provides a hydraulic circuit that includes a plurality of components fluidly coupled using piping or tubing suitable for conveying hydraulic fluid. As illustrated, the first pilot module 200*a* includes a first solenoid valve 202*a*, a second solenoid valve 202*b*, a filter 204, a first pilot module check valve 206*a*, and a second pilot module check valve 206*b*.

The first and second solenoid valves 202*a,b* are each electrically operated solenoid valves electrically coupled to a power source, such as the control line 122 of FIG. 1 or any of the downhole power sources mentioned herein. Command signals provided to the control system 120 (FIG. 1) trigger operation (activation) of the first and second solenoid valves 202*a,b*. In some embodiments, for example, a well operator may manually transmit command signals to operate the first and second solenoid valves 202*a,b*. In other embodiments, however, the command signals may originate from an automated computer programmed to transmit the command signals based on predetermined operating conditions or timing schemes. As discussed above, such command signals may be conveyed to the control system 120 via the control line(s) 122 (FIG. 1) or via any other wired or wireless means.

The first and second solenoid valves 202*a,b* are each two-way valves movable between a second position, where fluid flow through the valve is facilitated, and a first position, where fluid flow through the valve is substantially prevented in either direction. As shown in FIG. 2A, the first and second solenoid valves 202*a,b* are each depicted in the first (closed) position. Typically, the first and second solenoid valves 202*a,b* are naturally biased to the closed (e.g., first) position when not activated (i.e., normally closed valves) and shift to the open (e.g., second) position when activated. The solenoid valves of the present disclosure are depicted in the figures with symbols including adjacent (left and right) blocks. The left side block of each solenoid valve symbol can represent the nominal or "deactivated" position for a "no output" condition. The valve can be held in such a position passively, for example, by a spring, represented by a zig-zag symbol. The right side block of each solenoid valve symbol can represent the "activated" position. Upon activation, the valve has connections represented by the connections that would be made if the right side block is shifted to the depicted position of the left side block.

The first solenoid valve 202*a* is fluidly coupled to a pressure source 208 via a pressure supply line 210. The pressure source 208 may comprise any source of pressurized hydraulic fluid. In some embodiments, for example, the pressure source 208 may comprise the hydraulic line 124 of FIG. 1, which receives hydraulic fluid at the well surface 104 (FIG. 1) from a surface-located hydraulic source. In such embodiments, the pressure supply line 210 may be fluidly coupled to the hydraulic line 124, either directly or indirectly. In other embodiments, however, the pressure source 208 may comprise an external pump connected to the downhole tool 116 (FIG. 1) and fluidly coupled to the first pilot module 200*a* via suitable hydraulic lines. In yet other embodiments, as discussed below, the pressure source 208 may alternatively comprise an internal pump contained within the downhole tool 116 and fluidly coupled to the first pilot module 200*a*. In some embodiments, the pressure source 208 may alternatively comprise an accumulator that is a pre-charged hydraulic pressure source.

When triggered (activated), the first solenoid valve 202*a* moves to the open position and thereby provides (facilitates) pressure and flow from the pressure source 208 to an output 212 of the first pilot module 200*a*. The filter 204 is arranged in the pressure supply line 210 to remove contaminants from the supply fluid and thereby protect the first solenoid valve 202*a* or any downstream valve or device. In some embodiments, the output 212 may be fluidly coupled to an actuation device or discharge port of the downhole tool 116 (FIG. 1) and the hydraulic fluid provided at the output 212 may be used to operate (actuate) the downhole tool 116. In such embodiments, the actuation device may comprise an inflatable packer element or a piston/valve module, among other types of downhole tools and actuation devices. In some embodiments, the actuation device may comprise a ball valve, sleeve or spool valve, hydraulic motor, hydraulic cylinder, linear actuator, or rotary actuator. In other embodiments, however, the output 212 may communicate with a power module (not shown) also included in the control system 120 of FIG. 1. In such embodiments, the hydraulic fluid provided by the first solenoid valve 202*a* may comprise a pilot signal used to communicate with a pilot-operated check valve included in the power module.

The second solenoid valve 202*b* is arranged in a pressure return line 214 fluidly coupled to a fluid return 216 and is also in fluid communication with the output 212. When triggered (activated), the second solenoid valve 202*b* provides a drain function from the output 212 to the fluid return 216. In some embodiments, as illustrated, the fluid return 216 may comprise a hydraulic line fluidly coupled to the first pilot module 200*a* to serve as a drain or return line for displaced hydraulic fluid. In other embodiments, however, the fluid return 216 may alternatively comprise a discharge point where displaced hydraulic fluid from the output 212 can be discharged directly into the wellbore annulus 126 (FIG. 1).

In some embodiments, the first and second solenoid valves 202*a,b* may be zero-leak valves. In other embodiments, however, first and second solenoid valves 202*a,b* may not be zero-leak type valves. In such embodiments, the first and second pilot module check valves 206*a,b* may be used to reduce internal system leakage. The first pilot module check valve 206*a* is arranged in the pressure supply line 210 downstream from the first solenoid valve 202*a* and may be used as a hydraulic latching device that locks pressure downstream of the first solenoid valve 202*a*. The second pilot module check valve 206*b* is arranged in the pressure return line 214 downstream from the second solenoid valve 202*b* and may be used to isolate the first pilot module 200*a* and, more particularly, the second solenoid valve 202*b* from elevated fluid pressure that may be present in the fluid return 216. For example, in some applications, the pressure in the fluid return 216 may exceed that in the first pilot module 200*a* and the second pilot module check valve 206*b* prevents the elevated fluid pressure from migrating into the second solenoid valve 202*b* and thereby potentially disrupting proper operation of the first pilot module 200*a*.

Figure 2B:
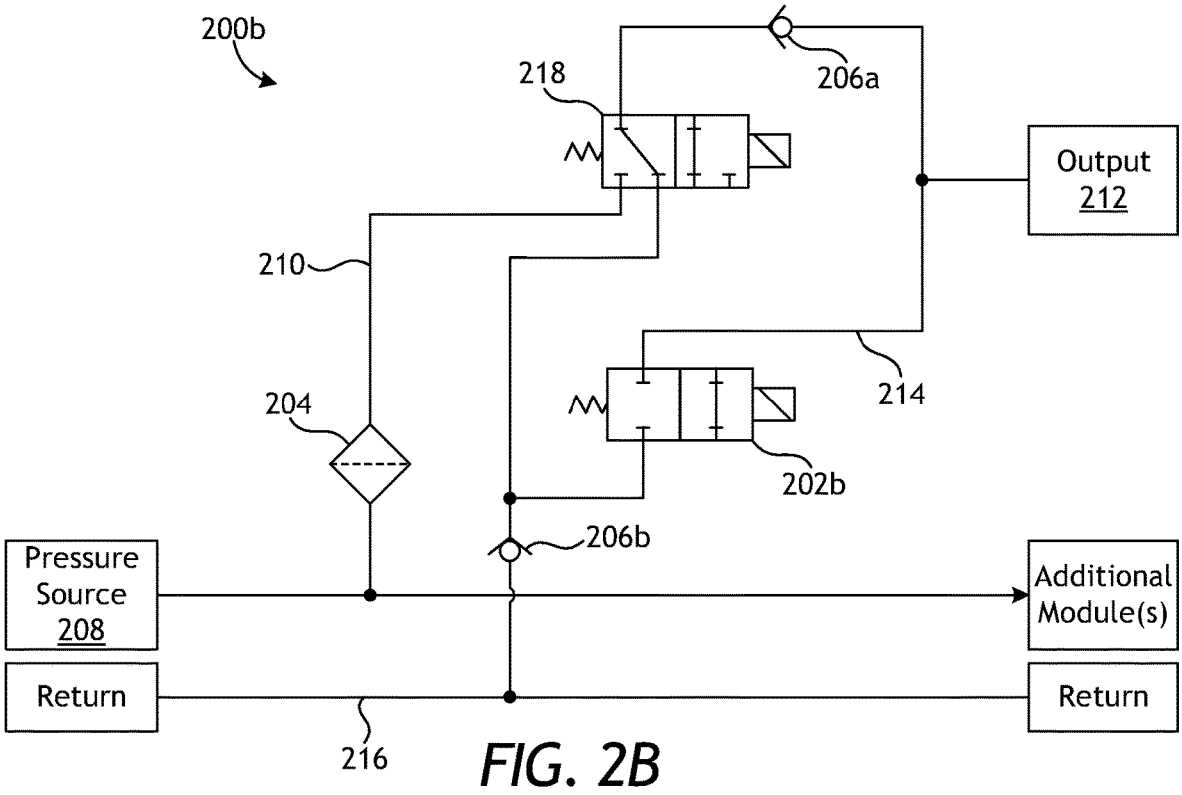
FIG. 2B is a schematic diagram of a second example pilot module.

FIG. 2B is a schematic diagram of a second example pilot module 200*b*, according to one or more embodiments. The second pilot module 200*b* may be similar in some respects to the first pilot module 200*a* of FIG. 2A and therefore may be best understood with reference thereto, where like numerals represent like elements not described again in detail. Similar to the first pilot module 200*a*, the second pilot module 200*b* may form part of the control system 120 of FIG. 1 and, therefore, may be used in controlling operation (actuation) of the downhole tool 116 (FIG. 1). Unlike the first pilot module 200*a*, however, the second pilot module 200*b* may be configured for higher fluid flow and drainage applications as compared to the first pilot module 200*a*. As illustrated, the second pilot module 200*b* includes the second solenoid valve 202*b*, the filter 204, the first and second pilot module check valves 206*a,b*, and a third solenoid valve 218.

Similar to the second solenoid valve 202*b*, the third solenoid valve 218 is electrically operated and electrically coupled to a power source (e.g., the control line 122 of FIG. 1 or a downhole power source). Command signals provided to the control system 120 (FIG. 1) trigger operation (activation) of the third solenoid valve 218, and such command signals may be conveyed to the control system 120 via the control line(s) 122 (FIG. 1) or via any other wired or wireless means.

Similar to the first solenoid valve 202*a* of FIG. 2A, the third solenoid valve 218 is arranged in the pressure supply line 210 and fluidly coupled to the pressure source 208. The third solenoid valve 218 is a three-way valve movable between a first position, where drainage through the valve is facilitated and a second position, where fluid flow from the pressure source 208 through the valve toward the output 212 is facilitated. As shown in FIG. 2B, the third solenoid valve 218 is depicted in the third (drainage) position. In contrast to the first and second solenoid valves 202*a,b*, the third solenoid valve 218 may not be a zero-leak valve.

Since the second pilot module 200*b* is configured for higher fluid flow as compared to the first pilot module 200*a* of FIG. 2A, the fluid pressure in the second pilot module 200*b* may be much larger than the fluid pressure in the first pilot module 200*a*. When triggered (activated), the third solenoid valve 218 moves to the open position and thereby provides (facilitates) pressure and flow from the pressure source 208 to the output 212 to either provide hydraulic fluid to an actuation device of the downhole tool 116 or provide a pilot signal to a fluidly coupled power module. The first and second pilot module check valves 206*a,b* are again used to reduce internal leakage and to isolate the third and second solenoid valves 218, 202*b*.

Because of the elevated pressures provided from the pressure source 208, however, and since the third solenoid valve 218 may not be a zero-leak valve, the third solenoid valve 218 may be susceptible to fluid leakage. In such applications, the third solenoid valve 218 may be triggered (by being activated or deactivated) to move to the first position to provide a means to drain any high-pressure leakage originating from the pressure source 208. Fluid draining through the third solenoid valve 218 fluidly communicates with fluid in the pressure return line 214 downstream from the second solenoid valve 202*b* and, therefore, is conveyed into the fluid return 216 so that the leakage does not adversely affect downstream functions at the output 212.

The second pilot module 200*b* may prove advantageous over the first pilot module 200*a* since the first pilot module 200*a* requires the first and second solenoid valves 202*a,b* to be zero-leak valves, whereas the third solenoid valve 218 of the second pilot module 200*b* is not required to be a zero-leak valve. Non-zero-leak valves are less expensive and more reliable as compared to zero-leak valves, and the three-way, third solenoid valve 218 allows any fluid leakage to be conveyed directly to the fluid return 216.

The design intent of the above-described first and second pilot modules 200*a,b*, and most other pilot modules, is to provide a latching function so that electrical and hydraulic pressure sources are provided only to shift the state of the modules, without having to sustain either the electrical or hydraulic power to the solenoid valves. This reduces total power demand and conserves energy in case electrical power is provided via a downhole power source (e.g., batteries, etc.), and reduces the need to maintain pump pressure from the pressure source 208.

Figure 3:
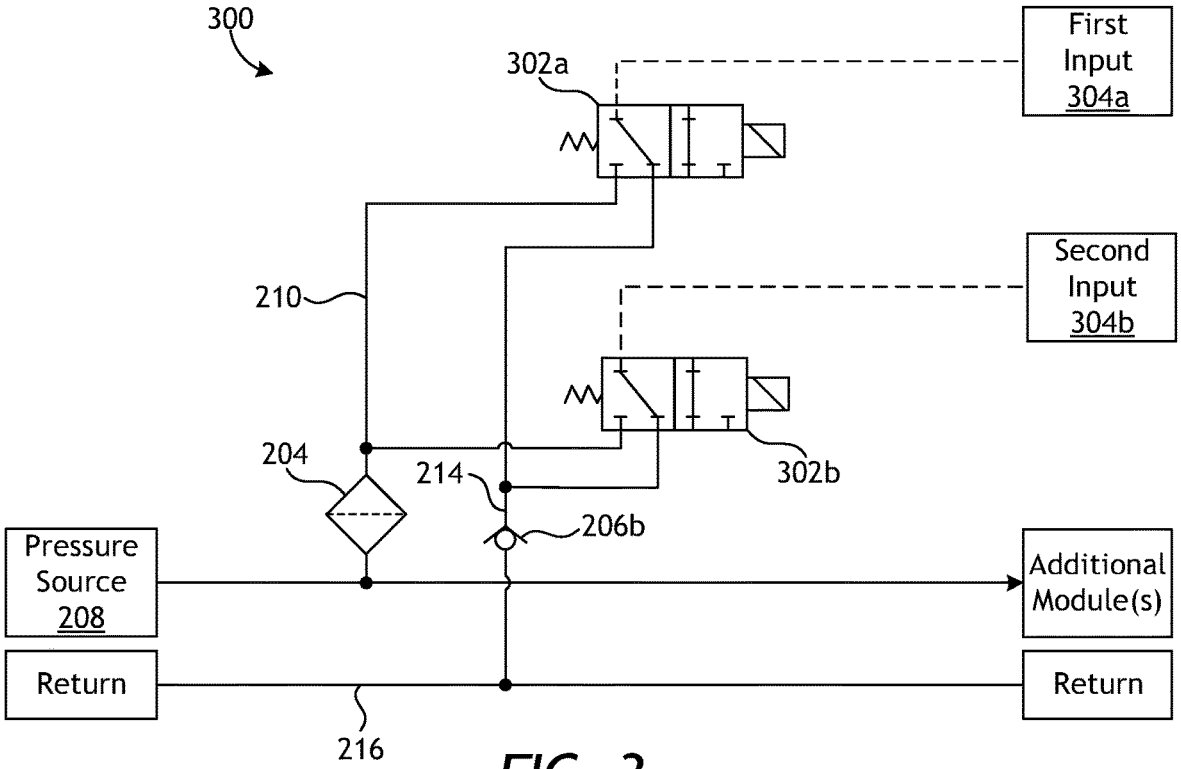
FIG. 3 is a schematic diagram of a third example pilot module.

FIG. 3 is a schematic diagram of a third example pilot module 300, according to one or more embodiments. The third pilot module 300 may be similar in some respects to the first and second pilot modules 200*a,b* of FIGS. 2A, 2B and therefore may be best understood with reference thereto, where like numerals represent like elements not described again. Similar to the first and second pilot modules 200*a,b*, the third pilot module 300 may form part of the control system 120 of FIG. 1 and, therefore, may be used in controlling operation (actuation) of the downhole tool 116 (FIG. 1). Unlike the first and second pilot modules 200*a,b*, however, which are two-way pilot modules, the third pilot module 300 is a four-way pilot module. As illustrated, the third pilot module 300 includes a fourth solenoid valve 302*a*, a fifth solenoid valve 302*b*, the filter 204, and the second pilot module check valve 206*b*.

The fourth and fifth solenoid valves 302*a,b* are electrically operated and electrically coupled to a power source, such as the control line 122 of FIG. 1 or any of the downhole power sources mentioned herein. Command signals provided to the control system 120 (FIG. 1) selectively trigger operation (activation) of the fourth and fifth solenoid valves 302*a,b*. Again, such command signals may be conveyed to the control system 120 via the control line(s) 122 (FIG. 1) or via any other wired or wireless means.

The fourth and fifth solenoid valves 302*a,b* are each three-way valves movable between a first position, where drainage through the valve is facilitated and a second position, where fluid flow from the pressure source 208 through the valve is facilitated. The fourth and fifth solenoid valves 302*a,b* are each depicted in FIG. 3 in the third (drainage) position. The fourth and fifth solenoid valves 302*a,b* may or may not be zero-leak valves.

The fourth solenoid valve 302*a* is arranged in the pressure supply line 210 and fluidly coupled to the pressure source 208. Upon activation of the fourth solenoid valve 302*a* to the second position, hydraulic fluid is conveyed from the pressure source 208 through the fourth solenoid valve 302*a* and to a first input 304*a* of a downstream power module (not shown). In some embodiments, hydraulic fluid conveyed to the first input 304*a* may be directly or indirectly transmitted to an actuation device of the downhole tool 116 (FIG. 1) and used to operate (actuate) the downhole tool 116. In such embodiments, the actuation device may comprise an inflatable packer element, a piston and valve module, a pump and motor module, a spool valve module, and other types of actuation devices used to actuate a downhole tool. In other embodiments, however, hydraulic fluid conveyed to the first input 304*a* from the fourth solenoid valve 302*a* may communicate with a power module (not shown) also included in the control system 120 of FIG. 1. In such embodiments, the hydraulic fluid conveyed to the first input 304*a* may comprise a pilot signal used to communicate with a pilot-operated check valve included in the power module.

Similar to the third solenoid valve 218, the fourth solenoid valve 302*a* may also be fluidly coupled to the pressure return line 214. When triggered (by being activated or deactivated) to move to the first position, the fourth solenoid valve 302*a* provides a means to drain any high pressure leakage originating from the pressure source 208 directly to the fluid return 216 so that the leakage does not adversely affect downstream functions of the power module associated with the first input 304*a*.

The fifth solenoid valve 302*b* is fluidly coupled to both the pressure source 208 and the fluid return 216 via the pressure supply line 210 and the pressure return line 214, respectively. Similar to the fourth solenoid valve 302*a*, the fifth solenoid valve 302*b* is configured to communicate with a downstream power module (not shown). More specifically, upon activation of the fifth solenoid valve 302*b* to the second position, hydraulic fluid is conveyed through the fifth solenoid valve 302*b* from the pressure source 208 and transmitted to a second input 304*b* of a downstream power module. Similar to operation of the fourth solenoid valve 302*a*, hydraulic fluid conveyed to the second input 304*b* via the fifth solenoid valve 302*b* may be directly or indirectly transmitted to an actuation device of the downhole tool 116 (FIG. 1) and used to operate (actuate) the downhole tool 116. In other embodiments, however, hydraulic fluid conveyed to the second input 304*b* from the fifth solenoid valve 302*b* may comprise a pilot signal used to communicate with a pilot-operated check valve included in the downstream power module.

The fifth solenoid valve 302*b* may also be fluidly coupled to the pressure return line 214 and, when triggered (by being activated or deactivated) to move to the first position, the fifth solenoid valve 302*b* provide a means to drain any high pressure leakage from the pressure source 208 directly to the fluid return 216. This prevents leakage from the pressure source 208 from adversely affecting downstream functions of the power module associated with the second input 304*b*. The second pilot module check valve 206*b* can be used to isolate the third pilot module 300 from high pressure in the fluid return 216.

Accordingly, both the fourth and fifth solenoid valves 302*a,b* may be capable of communicating hydraulic fluid to a downstream power module, and both may also be capable of providing a return path back through the respective valve. More specifically, in one scenario hydraulic fluid is pumped through the fourth solenoid valve 302*a* from the pressure source 208 to a downstream power module via the first input 304*a*. In this scenario, the third pilot module 300 receives return fluid from the downstream power module at the second input 304*b*, which conveys the return fluid through the fifth solenoid valve 302*b* and to the fluid return 216. Conversely, in another scenario hydraulic fluid may be pumped through the fifth solenoid valve 302*b* from the pressure source 208 to a downstream power module via the second input 304*b*. In this scenario, the third pilot module 300 receives return fluid from the downstream power module at the first input 304*a*, which conveys the return fluid through the fourth solenoid valve 302*a* and to the fluid return 216.

With the hydraulic circuit arrangement of the third pilot module 300, bi-directional (i.e., four-way) actuation devices as well as nominal two-way actuation devices associated with a downhole tool (e.g., the downhole tool 116 of FIG. 1) can be operated. Example four-way actuation devices include, but are not limited to hydraulic cylinders, pumps, and motors, and example two-way actuation devices include, but are not limited to, inflatable packer elements and spring loaded piston cylinders. As provided in the following figures, the four-way capable third pilot module 300 can be combined with a variety of example power modules for flexible operation of four-way and two-way actuation devices associated with the downhole tool 116.

Figure 4A:
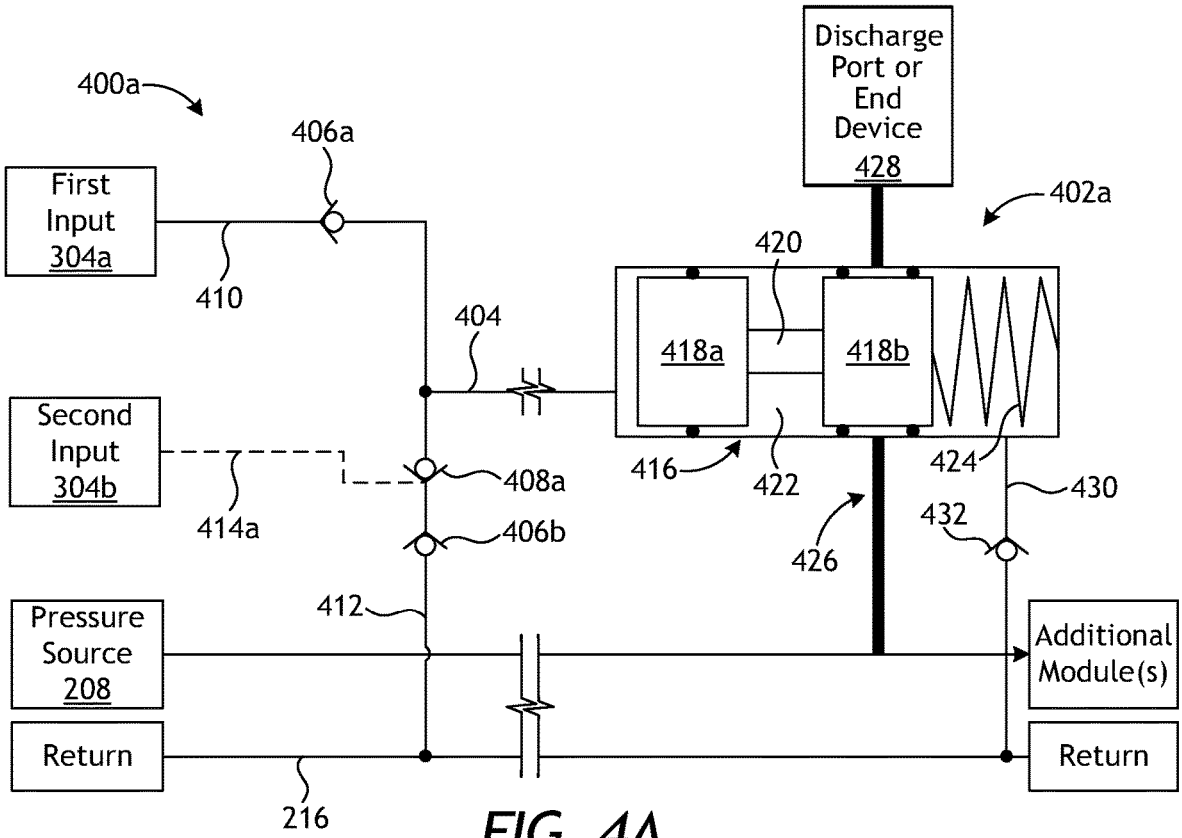
FIG. 4A is a schematic diagram of a first example power module.

FIG. 4A is a schematic diagram of a first example power module 400*a*, according to one or more embodiments. As with the pilot modules 200*a,b* and 300 described herein, the first power module 400*a* may form part of the control system 120 of FIG. 1 and, therefore, may be used in controlling operation (actuation) of the downhole tool 116 (FIG. 1). Moreover, the first power module 400*a* may be configured for operation with the third pilot module 300 of FIG. 3 to power (operate) a first actuation device 402*a*. More specifically, the first power module 400*a* may be characterized as a latching power module that is capable of using pressurized hydraulic fluid from the third pilot module 300 (FIG. 3) to power a first actuation device 402*a*, assuming the output of the third pilot module 300 provides sufficient hydraulic pressure to power the first actuation device 402*a*.

The first power module 400*a* includes the first and second inputs 304*a,b* discussed above, where the first input 304*a* is in fluid communication with the fourth solenoid valve 302*a* (FIG. 3) and the second input 304*b* is in fluid communication with the fifth solenoid valve 302*b* (FIG. 3). The first power module 400*a* may be configured to provide pressurized hydraulic fluid to the first actuation device 402*a* via an output line 404 and also receive hydraulic fluid from the first actuation device 402*a* via the output line 404. Consequently, the first power module 400*a* provides a two-way flow path through a single output line 404.

The first power module 400*a* includes a first power module check valve 406*a*, a second power module check valve 406*b*, and a first pilot-operated check valve 408*a*. The first power module check valve 406*a* is arranged downstream from the first input 304*a* in a power line 410, and the second power module check valve 406*b* is arranged in a control pressure return line 412 fluidly coupled to the fluid return 216. The first and second power module check valves 406*a,b* are used for latching and isolation, respectively. More specifically, the first power module check valve 406*a* allows pressurized hydraulic fluid from the first input 304*a* to pass directly to the first actuation device 402*a* via the output line 404, but prevent fluid returning from the output line 404 from flowing back toward the first input 304*a*. The second power module check valve 406*b* allows fluid to pass into the fluid return 216 via the control pressure return line 412, but isolates the first power module 400*a* from elevated fluid pressure that may be present in the fluid return 216.

The first pilot-operated check valve 408*a* is arranged in the control pressure return line 412 and fluidly communicates with the second input 304*b* via a first pilot line 414*a*. Based on hydraulic pilot signals received from the fifth solenoid valve 302*b* (FIG. 3) via the second input 304*b*, the first pilot-operated check valve 408*a* is actuatable between a closed position, where fluid flow to the fluid return 216 via the control pressure return line 412 is prevented, and an open position, where fluid flow to the fluid return 216 is allowed through the first pilot-operated check valve 408*a*.

In example operation of the first power module 400*a* in conjunction with the third pilot module 300 of FIG. 3, a first command signal is provided to the fourth solenoid valve 302*a* (FIG. 3) to allow pressurized hydraulic fluid to pass into the first power module 400*a* via the first input 304*a*. The pressurized hydraulic fluid passes through the first power module check valve 406*a* in the power line 410 and is conveyed directly to the first actuation device 402*a* via the output line 404. In the depicted example, the first actuation device 402*a* is in the form of a piston/valve module that includes a piston 416 having a first head 418*a* and a second head 418*b* separated from each other by a piston rod 420 and being movably arranged within a piston chamber 422. The hydraulic fluid in the output line 404 acts on the first head 418*a* and urges the piston 416 to move within the piston chamber 422 and against a biasing device 424 also arranged within the piston chamber 422. Movement of the piston 416 will eventually expose an actuation port 426 initially occluded by the second head 418*b*. The actuation port 426 is fluidly coupled to the pressure source 208 and, upon moving the piston 416 to expose the actuation port 426, pressurized hydraulic fluid is conveyed through the piston chamber 422 to an end device 428 for actuation of a downhole tool (e.g., the downhole tool 116 of FIG. 1) or to an external port for discharge or transport to another location. Optionally, actuation port 426 can be coupled to a power source (not shown) independent of the pressure source 208.

Once the downhole tool is properly actuated, a second command signal is provided to close the fourth solenoid valve 302*a* (FIG. 3) and thereby stop the flow of fluid against the first head 418*a* via the power line 410 and output line 404. At or near the same time, a third command signal is provided to the fifth solenoid valve 302*b* (FIG. 3) to send a pilot signal to the first pilot-operated check valve 408*a* via the first pilot line 414*a*. The pilot signal opens the first pilot-operated check valve 408*a* to allow flow to the fluid return 216 through the first pilot-operated check valve 408*a*. Spring force built up in the biasing device 424 urges the piston 416 in the opposite direction within the piston chamber 422, which displaces hydraulic fluid within the piston chamber 422 adjacent the first head 418*a* back into the output line 404. The displaced hydraulic fluid flows into the control pressure return line 412 to be received by the fluid return 216 via the first pilot-operated check valve 408*a* and the second power module check valve 406*b*. The second power module check valve 406*b* prevents the displaced hydraulic fluid from returning through the power line 410.

In some embodiments, the piston chamber 422 may be in fluid communication with the fluid return 216 via a vent line 430, and a vent line check valve 432 may be arranged in the vent line 430. The vent line 430 may help prevent hydraulic lock of the piston 416 as the piston 416 moves within the piston chamber 422.

Figure 4B:
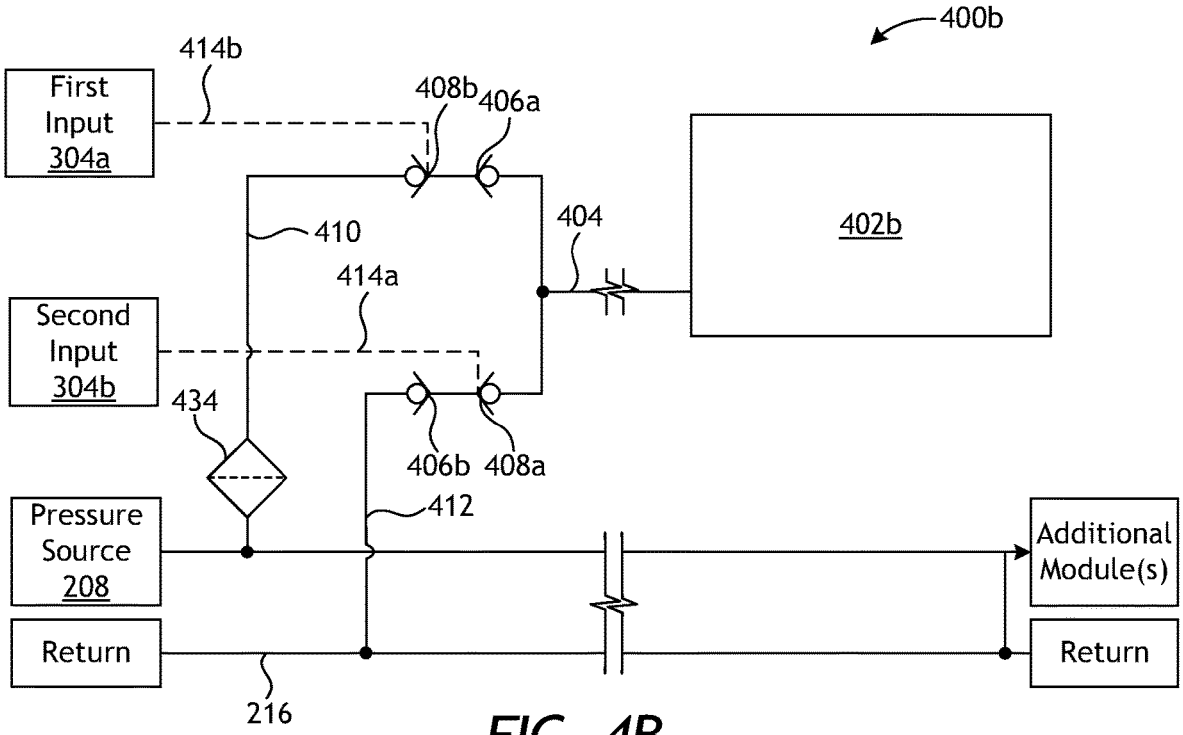
FIG. 4B is a schematic diagram of a second example power module.

FIG. 4B is a schematic diagram of a second example power module 400*b*, according to one or more embodiments. The second power module 400*b* may be similar in some respects to the first power module 400*a* of FIG. 4A and therefore may be best understood with reference thereto, where like numerals represent like components not described again. Similar to the first power module 400*a*, the second power module 400*b* may form part of the control system 120 of FIG. 1 to control operation (actuation) of the downhole tool 116 (FIG. 1). Moreover, the second power module 400*b* may be configured for operation with the third pilot module 300 of FIG. 3 to power (operate) a second actuation device 402*b*, depicted in FIG. 4B as an inflatable packer element. Unlike the first power module 400*a*, however, the second power module 400*a* may be able to provide increased hydraulic fluid flow to the second actuation device 402*b* via the output line 404, while still being controlled by the third pilot module 300.

The second power module 400*b* includes the first input 304*a* in fluid communication with the fourth solenoid valve 302*a* (FIG. 3) and the second input 304*b* in fluid communication with the fifth solenoid valve 302*b* (FIG. 3). Similar to the first power module 400*a*, the second power module 400*b* provides pressurized hydraulic fluid to the second actuation device 402*b* via the output line 404 and can also receive spent hydraulic fluid from the second actuation device 402*b* via the output line 404. Consequently, the second power module 400*b* provides a two-way flow path through the solitary (single) output line 404.

The second power module 400*b* includes the first power module check valve 406*a* and the second power module check valve 406*b*. The first power module check valve 406*a* is arranged in the power line 410, which, in this embodiment, fluidly communicates directly with the pressure source 208. A filter 434 is arranged in the power line 410 upstream from the first power module check valve 406*a* to remove contaminants from the supply fluid and thereby protect the second actuation device 402*b*. The second power module check valve 406*b* is again arranged in the control pressure return line 412.

The second power module 400*b* also includes the first pilot-operated check valve 408*a* arranged in the control pressure return line 412. Unlike the first power module 400*a*, however, the second power module 400*b* also includes a second pilot-operated check valve 408*b* arranged in the power line 410 and fluidly communicating with the first input 304*a* via a second pilot line 414*b*. Based on pilot signals received from the fourth solenoid valve 302*a* via the first input 304*a*, the second pilot-operated check valve 408*b* is actuatable between a closed position, where fluid flow to the second actuation device 402*b* via the power line 410 is prevented, and an open position, where fluid flow to the second actuation device 402*b* is allowed through the second pilot-operated check valve 408*b*.

In example operation of the second power module 400*b* in conjunction with the third pilot module 300 of FIG. 3, a first command signal is provided to the fourth solenoid valve 302*a* (FIG. 3) to send a first pilot signal to the second pilot-operated check valve 408*b* via the first input 304*a* and the second pilot line 414*b*. The first pilot signal opens the second pilot-operated check valve 408*b* to allow pressurized hydraulic fluid to pass into the second power module 400*b* from the pressure source 208 via the power line 410. The pressurized hydraulic fluid passes through the second pilot-operated check valve 408*b* in the power line 410 and is conveyed directly to the second actuation device 402*b* via the output line 404. While depicted in FIG. 4B as an inflatable packer element, the second actuation device 402*b* could alternatively be any two-way hydraulically operated device module similar to the first actuation device 402*a* of FIG. 4A, without departing from the scope of the disclosure. The incoming hydraulic fluid serves to actuate and otherwise inflate the second actuation device 402*b*, which forms part of a downhole tool (e.g., the downhole tool 116 of FIG. 1).

Once the downhole tool is properly actuated, a second command signal is provided to the fourth solenoid valve 302*a* (FIG. 3) to send a second pilot signal that closes the second pilot-operated check valve 408*b* via the first input 304*a* and thereby stops the flow of fluid to the second actuation device 402*b* via the power line 410. The second pilot signal can include a signal that is different from the first pilot signal. Alternatively, the second pilot signal can include the absence of the first pilot signal, such that the second pilot-operated check valve 408*b* no longer maintains an activated or open position and is allowed to close itself (e.g., by spring-operated return to a closed or deactivated position). At or near the same time, a third command signal is provided to the fifth solenoid valve 302*b* (FIG. 3) to send a third pilot signal to the first pilot-operated check valve 408*a*. The third pilot signal opens the first pilot-operated check valve 408*a* to allow flow to the fluid return 216 through the first pilot-operated check valve 408*a*. Spent hydraulic fluid from the second actuation device 402*b* may be received by the fluid return 216 via the first pilot-operated check valve 408*a* and the second power module check valve 406*b*. The first power module check valve 406*a* again prevents the displaced hydraulic fluid from returning through the power line 410, and the second power module check valve 406*b* can be used to prevent possible high pressure in the fluid return 216 from entering system.

Figure 5A:
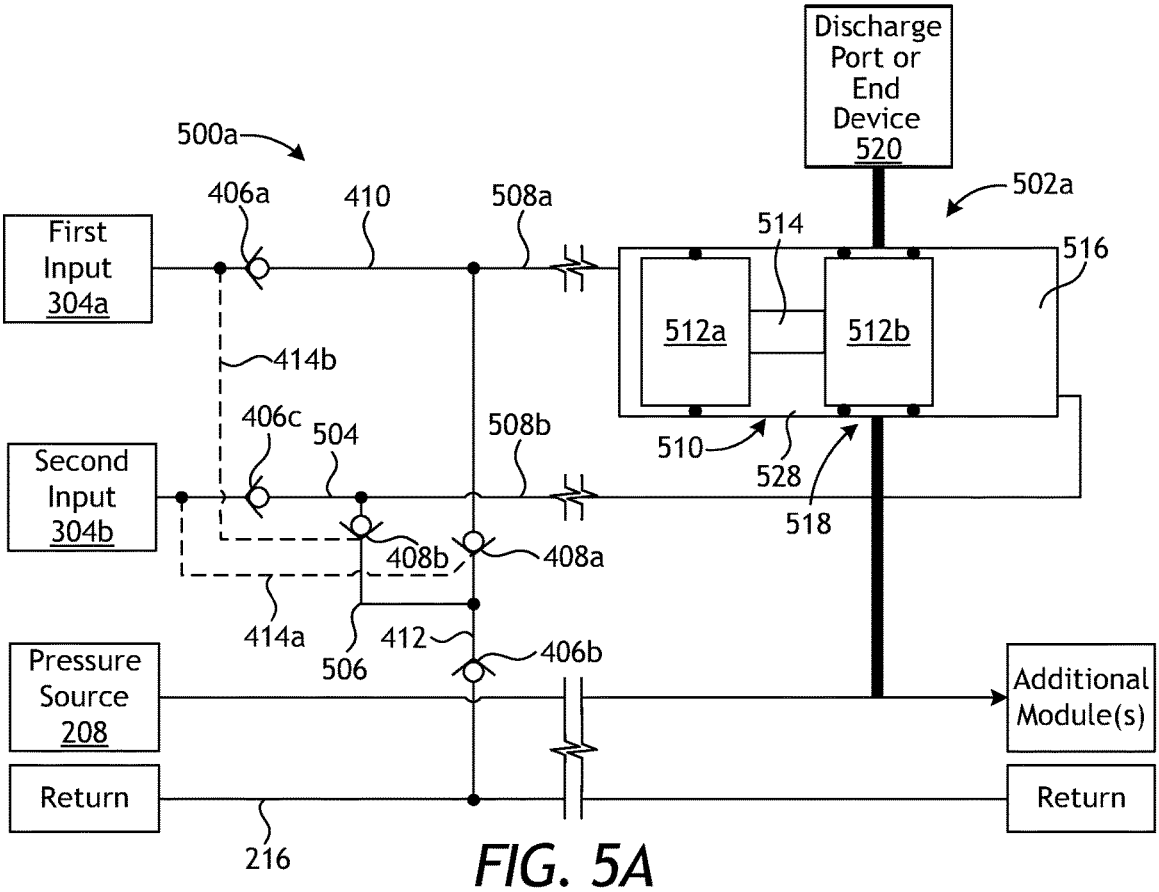
FIG. 5A is a schematic diagram of a third example power module.
Figure 5B:
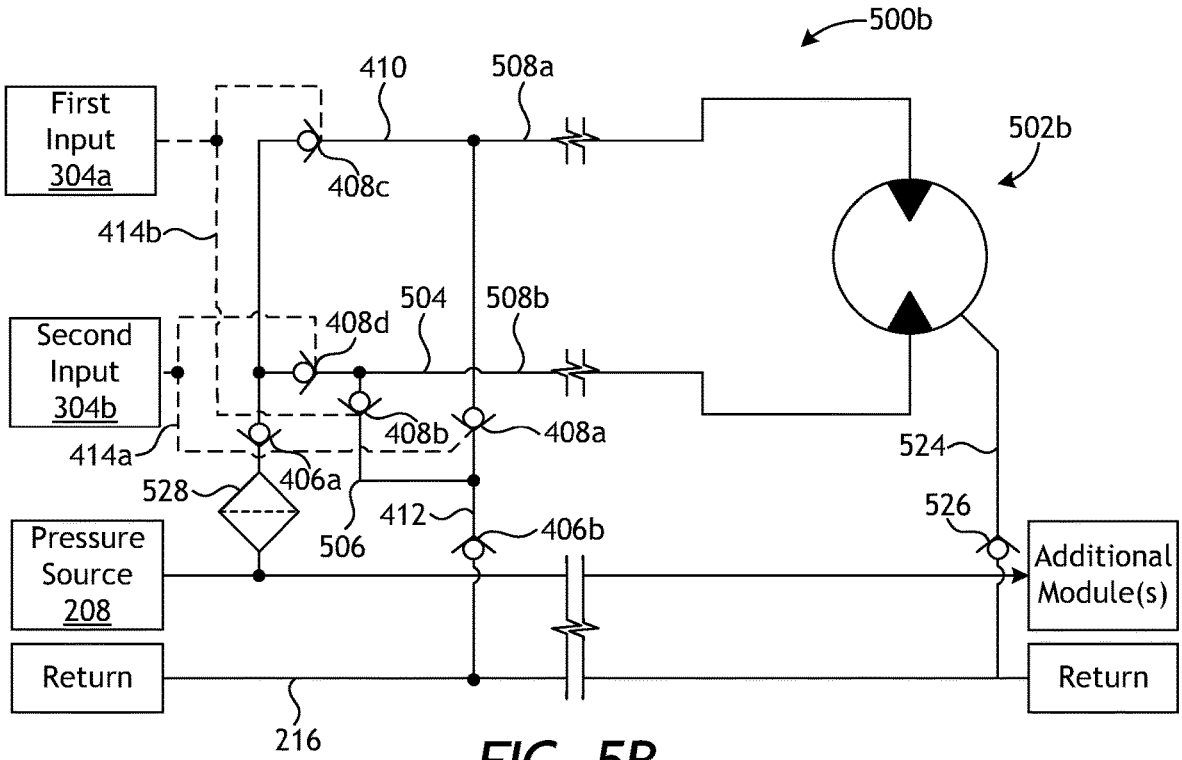
FIG. 5B is a schematic diagram of a fourth example power module.

FIGS. 5A and 5B depict schematic diagrams of two example four-way power modules that can be used to control actuation devices such as bi-directional cylinders and hydraulic motors. Similar to the first and second power modules 400*a,b*, the power modules described and shown in FIGS. 5A and 5B may form part of the control system 120 of FIG. 1 to control operation (actuation) of the downhole tool 116 (FIG. 1). The power modules of FIGS. 5A and 5B are completely bi-directional where flow can be provided to or received from the corresponding actuation device depending on the state of the pilot module.

In FIG. 5A, a third example power module 500*a* is depicted, according to one or more embodiments of the disclosure. The third power module 500*a* may be similar in some respects to the first and second power modules 400*a,b* of FIGS. 4A and 4B, respectively, and therefore may be best understood with reference thereto, where like numerals represent like components not described again. As illustrated, the third power module 500*a* may be configured to help facilitate operation (actuation) of a third actuation device 502*a*, depicted in FIG. 5A as a spool and valve module. The third power module 500*a* can be used to provide bi-directional hydraulic power to the third actuation device 502*a* if the four-way third pilot module 300 provides sufficient hydraulic output to operate the third actuation device 502*a*.

The third power module 500*a* includes the first and second inputs 304*a,b* discussed above, where the first input 304*a* is in fluid communication with the fourth solenoid valve 302*a* (FIG. 3) and the second input 304*b* is in fluid communication with the fifth solenoid valve 302*b* (FIG. 3). Moreover, the first power module check valve 406*a* is arranged in the power line 410 and the second power module check valve 406*b* is arranged in the control pressure return line 412. The third power module 500*a* further includes a third power module check valve 406*c* arranged in a second power line 504. The third power module check valve 406*c* operates similar to the first power module check valve 406*a* in preventing fluid from flowing back into the second input 304*b*.

The third power module 500*a* also includes the first and second pilot-operated check valves 408*a,b*. The first pilot-operated check valve 408*a* is arranged in the control pressure return line 412 at the end of the first pilot line 414*a*, and the second pilot-operated check valve 408*b* is arranged in a bypass line 506 at the end of the second pilot line 414*b*. As illustrated, the bypass line 506 fluidly communicates with the second power line 504 and the control pressure return line 412.

Unlike the first and second power modules 400*a,b*, the third power module 500*a* communicates with the third actuation device 502*a* via a first output line 508*a* and a second output line 508*b*. More particularly, hydraulic fluid conveyed to the first input 304*a* may be directly transmitted to the third actuation device 502*a* via the power line 410 and the first output line 508*a*, and hydraulic fluid conveyed to the second input 304*b* may be directly transmitted to the third actuation device 502*a* via the second power line 504 and the second output line 508*b*.

Example operation of the third power module 500*a* in conjunction with the third pilot module 300 of FIG. 3 is now provided. A first command signal is provided to the fourth solenoid valve 302*a* (FIG. 3) to allow pressurized hydraulic fluid to pass into the third power module 500*a* via the first input 304*a*. The pressurized hydraulic fluid passes through the first power module check valve 406*a* in the power line 410 and is conveyed directly to the third actuation device 502*a* via the first output line 508*a*.

In the depicted example, the third actuation device 502*a* is in the form of a spool valve module that includes a piston 510 having a first head 512*a* and a second head 512*b* separated from each other by a piston rod 514 and being movably arranged within a piston chamber 516. The hydraulic fluid in the first output line 508*a* acts on the first head 512*a* and urges the piston 510 to move within the piston chamber 516. Movement of the piston 510 will eventually expose an actuation port 518 initially occluded by the second head 512*b*. The actuation port 518 is fluidly coupled to the pressure source 208 and, upon moving the piston 510 to expose the actuation port 518, pressurized hydraulic fluid is conveyed through the piston chamber 522 to an end device 520 for actuation of a downhole tool (e.g., the downhole tool 116 of FIG. 1) or to an external port for discharge or transport to another location. Optionally, actuation port 518 can be coupled to a power source (not shown) independent of the pressure source 208.

As the piston 510 is urged to move within the piston chamber 516, hydraulic fluid is displaced from the piston chamber 516 into the second output line 508*b*. The pressurized hydraulic fluid passing through the first input 304*a* to actuate the third actuation device 502*a* may also simultaneously provide a first pilot signal to the second pilot-operated check valve 408*b* via the second pilot line 414*b*. The first pilot signal opens the second pilot-operated check valve 408*b* and thereby allows the displaced hydraulic fluid from the second output line 508*b* to flow into the bypass line 506, where the displaced hydraulic fluid is able communicate with the fluid return 216 via the second pilot-operated check valve 408*b* and the second power module check valve 406*b*. The third power module check valve 406*c* prevents the displaced hydraulic fluid from returning through the second power line 504, and the first pilot-operated check valve 408*a* prevents the displaced hydraulic fluid from flowing directly to the fluid return 216 via the control pressure return line 412.

Once the downhole tool is properly actuated, a second command signal is provided to close the fourth solenoid valve 302*a* (FIG. 3) and thereby stop the flow of fluid against the first head 512*a* via the first power line 410 and first output line 508*a*. If it is desired to move the third actuation device 502*a* again and thereby close the actuation port 518, a third command signal is provided to the fifth solenoid valve 302*b* (FIG. 3) to allow pressurized hydraulic fluid to pass into the third power module 500*a* via the second input 304*b*. The pressurized hydraulic fluid passes through the third power module check valve 406*c* in the second power line 504 and is conveyed directly to the third actuation device 502*a* via the second output line 508*b*. The hydraulic fluid in the second output line 508*b* acts on the second head 512*b* and urges the piston 510 to move the opposite direction within the piston chamber 516 until the actuation port 518 is once again occluded by the second head 512*b*.

As the piston 510 is urged to move within the piston chamber 516 the opposite direction, hydraulic fluid is displaced from the piston chamber 516 into the first output line 508*a*. The pressurized hydraulic fluid passing through the second input 304*b* to actuate the third actuation device 502*a* may also simultaneously provide a second pilot signal to the first pilot-operated check valve 408*a* via the first pilot line 414*a*. The second pilot signal can include a signal that is different from the first pilot signal or the absence of the first pilot signal. The second pilot signal opens the first pilot-operated check valve 408*a* and thereby allows the displaced hydraulic fluid from the first output line 508*a* to flow into control pressure return line 412 to be received by the fluid return 216 via the first pilot-operated check valve 408*a* and the second power module check valve 406*b*. The first power module check valve 406*a* prevents the displaced hydraulic fluid from returning through the power line 410.

Accordingly, by selectively activating (operating) the fourth and fifth solenoid valves 302*a,b* (FIG. 2), the third power module 500*a* facilitates circulating flow in either direction, similar to the way a conventional four-way hydraulic valve operates. However, the third power module 500*a* also provides latching capabilities with the first and third power module check valves 406*a,c* so that once the first or second output lines 508*a,b* are pressurized, they will tend to stay that way.

In FIG. 5B, a fourth example power module 500*b* is depicted, according to one or more embodiments of the disclosure. The fourth power module 500*b* may be similar in some respects to the third power module 500*a* of FIG. 5A and therefore may be best understood with reference thereto, where like numerals represent like components not described again. As illustrated, the fourth power module

500*b* may be configured to help facilitate operation (actuation) of a fourth actuation device 502*b*, depicted in FIG. 5B as a motor module. The fourth power module 500*b* can be used to provide bi-directional hydraulic power to the fourth actuation device 502*b* in applications where the four-way third pilot module 300 of FIG. 3 does not provide sufficient hydraulic output to operate the fourth actuation device 502*b*.

Similar to the third power module 500*a*, the fourth power module 500*b* includes the first and second inputs 304*a,b*, where the first input 304*a* is in fluid communication with the fourth solenoid valve 302*a* (FIG. 3) and the second input 304*b* is in fluid communication with the fifth solenoid valve 302*b* (FIG. 3). Moreover, the first power module check valve 406*a* is arranged in the power line 410 and the second power module check valve 406*b* is arranged in the control pressure return line 412. The third power module 500*a* further includes the first pilot-operated check valve 408*a* arranged in the control pressure return line 412 at the end of the first pilot line 414*a* and the second pilot-operated check valve 408*b* arranged in the bypass line 506 at the end of the second pilot line 414*b*. Furthermore, the fourth power module 500*b* also communicates with the fourth actuation device 502*b* via the first output line 508*a* and a second output line 508*b*, as generally described above.

Unlike the third power module 500*a*, however, the power line 410 in the fourth power module 500*b* fluidly communicates directly with the pressure source 208, and a filter 528 is arranged in the power line 410 upstream from the first power module check valve 406*a* to remove contaminants from the supply fluid and thereby protect the fourth actuation device 502*b*. Moreover, the fourth power module 500*b* also includes a third pilot-operated check valve 408*c* and a fourth pilot-operated check valve 408*d*. The third pilot-operated check valve 408*c* is arranged in the first power line 410 and fluidly communicates with the first input 304*a* via one branch of the second pilot line 414*b*, and the fourth pilot-operated check valve 408*d* is arranged in the second power line 504 and fluidly communicates with the second input 304*b* via one branch the first pilot line 414*a*. As illustrated, the second power line 504 is directly coupled to the pressure source 208 via the first power line 410. Based on a pilot signal received from the fourth solenoid valve 302*a* (FIG. 3) via the first input 304*a*, the second and third pilot-operated check valves 408*b,c* are actuatable between closed and open positions. Similarly, based on a pilot signal received from the fifth solenoid valve 302*b* (FIG. 3) via the second input 304*b*, the first and fourth pilot-operated check valves 408*a,d* are actuatable between closed and open positions.

Example operation of the fourth power module 500*b* in conjunction with the third pilot module 300 of FIG. 3 is now provided. A first command signal is provided to the fourth solenoid valve 302*a* (FIG. 3) to send a first pilot signal to the second and third pilot-operated check valves 408*b,c* via the first input 304*a* and the second pilot line 414*b*. The first pilot signal opens the third pilot-operated check valve 408*c* to allow pressurized hydraulic fluid from the pressure source 208 to pass through the first power module check valve 406*a* in the power line 410 to be conveyed directly to the fourth actuation device 502*b* via the first output line 508*a*. The pressurized hydraulic fluid operates (actuates) the fourth actuation device 502*b*.

As the fourth actuation device 502*b* operates, hydraulic fluid is displaced into the second output line 508*b*. The first pilot signal that opens the third pilot-operated check valve 408*c* may also simultaneously communicate with the second pilot-operated check valve 408*b* via a branch of the second pilot line 414*b*. Accordingly, the first pilot signal may also open the second pilot-operated check valve 408*b* to allow the displaced hydraulic fluid from the second output line 508*b* to flow into the bypass line 506 and subsequently communicate with the fluid return 216 via the second pilot-operated check valve 408*b* and the second power module check valve 406*b*.

Once the fourth actuation device 502*b* and associated downhole tool is properly actuated, a second command signal is provided to close the fourth solenoid valve 302*a* (FIG. 3) to send a second pilot signal that closes the second and third pilot-operated check valves 408*b,c* via the first input 304*a* and thereby stops the flow of fluid to the fourth actuation device 502*b* via the power line 410. The second pilot signal can include a signal that is different from the first pilot signal or the absence of the first pilot signal. If it is desired to reverse the third actuation device 502*a*, a third command signal is provided to the fifth solenoid valve 302*b* (FIG. 3) to send a third pilot signal to the first and fourth pilot-operated check valves 408*a,d*. The third pilot signal opens the fourth pilot-operated check valve 408*d* to allow pressurized hydraulic fluid to pass into the second power line 504 coupled indirectly to the pressure source 208. The pressurized hydraulic fluid passes through the first power module check valve 406*a* in the first power line 410 before branching off into the second power line 504 to be transmitted directly to the fourth actuation device 502*b* via the second output line 508*b*.

As the fourth actuation device 502*b* operates in reverse, hydraulic fluid is displaced into the first output line 508*a*. The third pilot signal provided at the second input 304*b* that actuates the fourth pilot-operated check valve 408*d* may also simultaneously communicate with the first pilot-operated check valve 408*a* via a branch of the first pilot line 414*a*. Accordingly, the third pilot signal may also open the first pilot-operated check valve 408*a* to allow the displaced hydraulic fluid from the first output line 508*a* to flow into the control pressure return line 412 and subsequently communicate with the fluid return 216 via the first pilot-operated check valve 408*a* and the second power module check valve 406*b*.

In some embodiments, the fourth actuation device 502*b* may be in direct fluid communication with the fluid return 216 via a vent line 524, and a vent line check valve 526 may be arranged in the vent line 524. The vent line 524 may help prevent hydraulic lock of the fourth actuation device 502*b*, or allow drainage of any internal leakage.

In the preceding examples of pilot and power modules, the pressure source 208 provides the hydraulic fluid required to actuate (operate) the corresponding actuation devices. The pressure source 208 is generally depicted as a pressure line and the spent or displaced hydraulic fluid is passed to the fluid return 216 after actuating the actuation device. As briefly mentioned above, however, the pressure source 208 can alternatively comprise a pump that is externally or internally mounted to the downhole tool (e.g., the downhole tool 116 of FIG. 1) and fluidly coupled to the pilot and power modules via suitable hydraulic lines.

A pressure source 208 can be shared by separate modules. Alternatively, each module can include separate and independent pressure sources 208. For example, any two or more of the first pilot module 200*a*, the second pilot module 200*b*, the third pilot module 300, the first power module 400*a*, the second power module 400*b*, the third power module 500*a*, and the fourth power module 500*b* can include the same pressure source 208 or separate pressure sources 208.

Figure 5C:
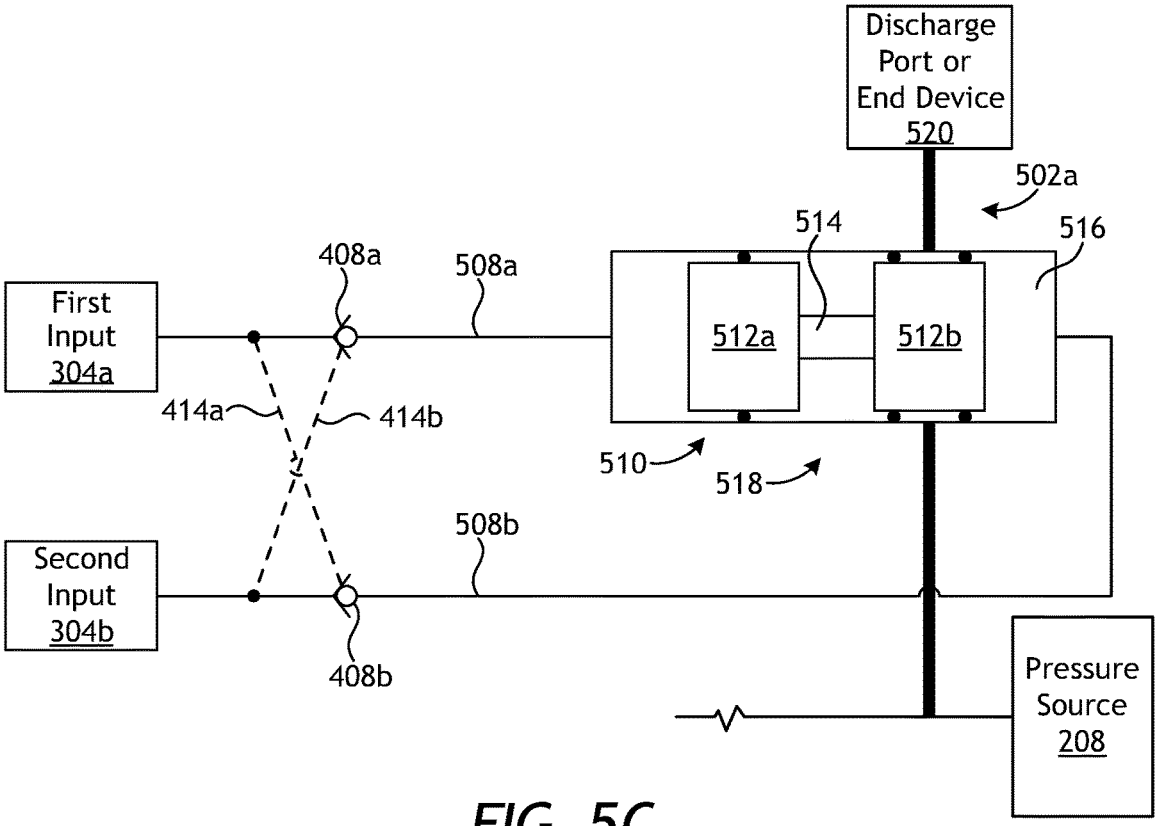
FIG. 5C is a schematic diagram of a fifth example power module.

FIG. 5C is a schematic diagram of a fifth example power module 500*c*, according to one or more embodiments. The fifth power module 500*c* may be similar in some respects to the first and third power modules 400*a* and 500*a* of FIGS. 4A and 5A, respectively, and therefore may be best understood with reference thereto, where like numerals represent like components not described again. The fifth power module 500*c* can provide sufficient power to operate a spool, sliding sleeve, ball, or other type valve directly and in a bi-directional fashion. As illustrated, the fifth power module 500*c* may be configured to help facilitate operation (actuation) of a third actuation device 502*a*, depicted in FIG. 5C as a spool and valve module. An on-board hydraulic supply module, such as pressure source 600, discussed below, can be provided separately and from the main surface pump line.

The fifth power module 500*c* includes the first and second inputs 304*a,b* discussed above, where the first input 304*a* is in fluid communication with the fourth solenoid valve 302*a* (FIG. 3) and the second input 304*b* is in fluid communication with the fifth solenoid valve 302*b* (FIG. 3). Moreover, the first pilot-operated check valve 408*a* is arranged in the first output line 508*a* and the second pilot-operated check valve 408*b* is arranged in the second output line 508*b*.

The fifth power module 500*c* also includes the first and second pilot-operated check valves 408*a,b*. The first pilot-operated check valve 408*a* is arranged in the first output line 508*a* at the end of the second pilot line 414*b*, and the second pilot-operated check valve 408*b* is arranged in a second output line 508*b* at the end of the first pilot line 414*a*.

The fifth power module 500*c* can communicate with the third actuation device 502*a* via the first output line 508*a* and the second output line 508*b*. More particularly, hydraulic fluid conveyed to the first input 304*a* may be directly transmitted to the third actuation device 502*a* via the first output line 508*a*, and hydraulic fluid conveyed to the second input 304*b* may be directly transmitted to the third actuation device 502*a* via the second output line 508*b*.

Example operation of the fifth power module 500*c* in conjunction with the third pilot module 300 of FIG. 3 is now provided. A first command signal is provided to the fourth solenoid valve 302*a* (FIG. 3) to allow pressurized hydraulic fluid to pass into the fifth power module 500*c* via the first input 304*a*. The pressurized hydraulic fluid passes through the first pilot-operated check valve 408*a* and is conveyed directly to the third actuation device 502*a* via the first output line 508*a*. Pilot pressure is applied to open second pilot-operated check valve 408*b* via first pilot line 414*a*, allowing displaced fluid returning through second output line 508*b* indirectly to the fluid return 216 via second input 304*b* and fifth solenoid valve 302*b* (FIG. 3).

In the depicted example, the third actuation device 502*a* is in the form of a spool valve module that includes a piston 510 having a first head 512*a* and a second head 512*b* separated from each other by a piston rod 514 and being movably arranged within a piston chamber 516. The hydraulic fluid in the first output line 508*a* acts on the first head 512*a* and urges the piston 510 to move within the piston chamber 516. Movement of the piston 510 will eventually expose an actuation port 518 initially occluded by the second head 512*b*. The actuation port 518 is fluidly coupled to the pressure source 208 and, upon moving the piston 510 to expose the actuation port 518, pressurized hydraulic fluid is conveyed through the piston chamber 522 to an end device 520 for actuation of a downhole tool (e.g., the downhole tool 116 of FIG. 1) or to an external port for discharge or transport to another location. Optionally, actuation port 518 can be coupled to a power source (not shown) independent of the pressure source 208.

As the piston 510 is urged to move within the piston chamber 516, hydraulic fluid is displaced from the piston chamber 516 into the second output line 508*b*. The pressurized hydraulic fluid passing through the first input 304*a* to actuate the third actuation device 502*a* may also simultaneously provide a first pilot signal to the second pilot-operated check valve 408*b* via the second pilot line 414*b*. The first pilot signal opens the second pilot-operated check valve 408*b* and thereby allows the displaced hydraulic fluid from the second output line 508*b* to flow into the bypass line 506, where the displaced hydraulic fluid is able communicate with the fluid return 216 via the second pilot-operated check valve 408*b*.

Once the downhole tool is properly actuated, a second command signal is provided to close the fourth solenoid valve 302*a* (FIG. 3) and thereby stop the flow of fluid against the first head 512*a* via the first power line 410 and first output line 508*a*. If it is desired to move the third actuation device 502*a* again and thereby close the actuation port 518, a third command signal is provided to the fifth solenoid valve 302*b* (FIG. 3) to allow pressurized hydraulic fluid to pass into the fifth power module 500*c* via the second input 304*b*. The pressurized hydraulic fluid is conveyed directly to the third actuation device 502*a* via the second output line 508*b*. The hydraulic fluid in the second output line 508*b* acts on the second head 512*b* and urges the piston 510 to move the opposite direction within the piston chamber 516 until the actuation port 518 is once again occluded by the second head 512*b*.

As the piston 510 is urged to move within the piston chamber 516 the opposite direction, hydraulic fluid is displaced from the piston chamber 516 into the first output line 508*a*. The pressurized hydraulic fluid passing through the second input 304*b* to actuate the third actuation device 502*a* may also simultaneously provide a second pilot signal to the first pilot-operated check valve 408*a* via the first pilot line 414*a*. The second pilot signal can include a signal that is different from the first pilot signal or the absence of the first pilot signal. The second pilot signal opens the first pilot-operated check valve 408*a* and thereby allows the displaced hydraulic fluid from the first output line 508*a* to be received by the fluid return 216 via the first pilot-operated check valve 408*a*.

In a similar fashion, second input 304*b* provides pressurized hydraulic fluid through second pilot-operated check valve 408*b* and then to the example spool valve shown via second output line 508*b*. Simultaneously, pilot pressure is applied to open the first pilot-operated check valve 408*a* via second pilot line 414*b*, allowing displaced fluid returning through first output line 508*a* indirectly to the fluid return 216 in FIG. 3 via first input 304*a* and solenoid valve 302*a*.

Figure 6:
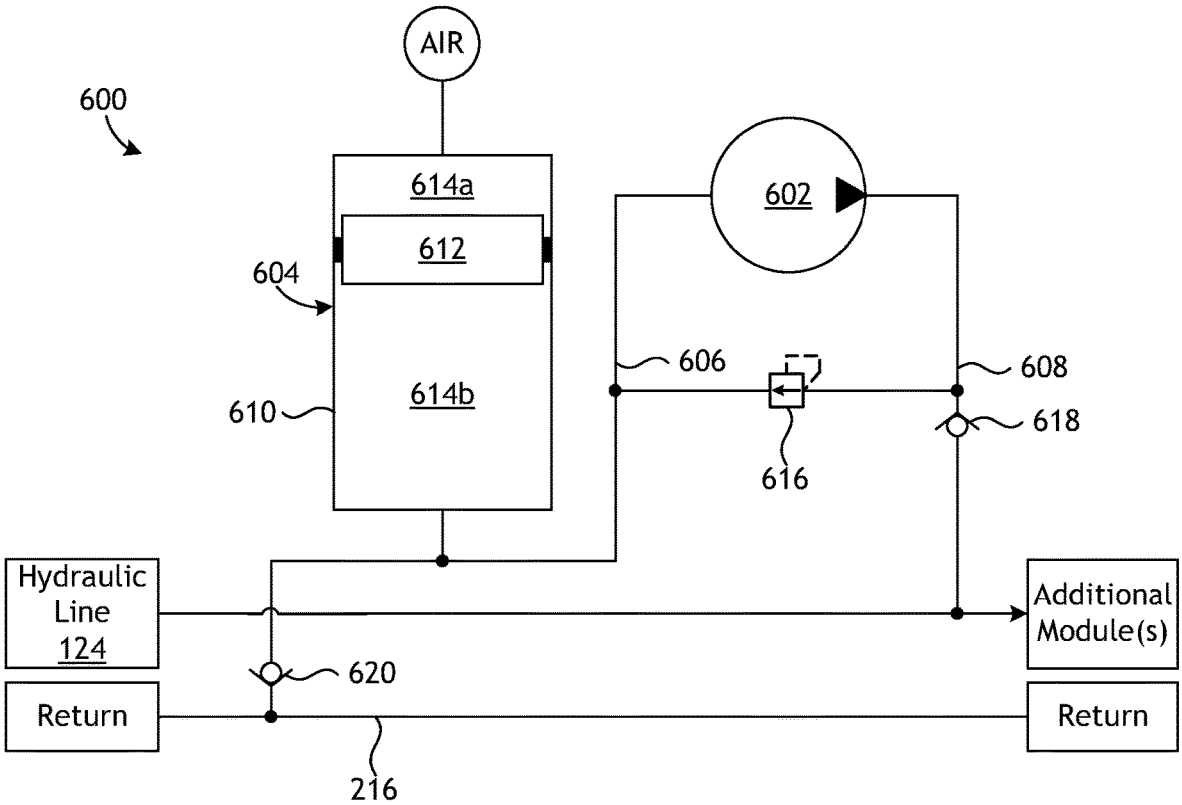
FIG. 6 is a schematic diagram of an example pressure source that may be used in conjunction with any of the pilot and power modules described herein.

FIG. 6 is a schematic diagram of an example pressure source 600, according to one or more embodiments. The pressure source 600 may be the same as or similar to the pressure source 208 of FIGS. 2A-2B, 3, 4A-4B, and 5A-5B. Accordingly, the pressure source 600 may be configured to be used in conjunction with and provide hydraulic fluid to any of the pilot and power modules described herein. As illustrated, the pressure source 600 includes a pump 602, such as a positive displacement pump, and fluid reservoir 604 fluidly coupled to the pump 602. A fluid intake line 606 fluidly couples both the pump 602 and the fluid reservoir 604 to the fluid return 216, and a fluid discharge line 608 fluidly couples the pump 602 to a source of pressure hydraulic fluid, such as the hydraulic line(s) 124 discussed with respect to FIG. 1.

The fluid reservoir 604 provides a tank 610 may include a piston 612, which is movably arranged in the tank 610. The tank 610 charged with a gas 614*a*, such as air, above the piston 612, and hydraulic fluid 614*b* fills the tank 610 below the piston 612. Charging the tank 610 with the gas 614*a* constantly urges the piston 612 against the hydraulic fluid. As a result, a specific orientation of the fluid reservoir 604 is not required when arranged and charged, thus the fluid reservoir 604 serves as a special hydraulic fluid reservoir that can provide hydraulic fluid 614*b* regardless of the orientation of the tank, and also prevents air entrainment into the control system 120 (FIG. 1).

A tank check valve 620 can be included between the tank 610 and the fluid return 216. The tank check valve 620 can reduce or prevent loss of charge of the gas 614*a* due to leakage through the fluid return 216. A relief valve 616 can be included and connected to opposing sides of the pump 602. For example, the relief valve 616 can be connected to the fluid intake line 606 and the fluid discharge line 608. The relief valve 616 can protect the pump 602 and downstream components from excessive pressure. A discharge line check valve 618 can be included along the fluid discharge line 608. The discharge line check valve 618 can prevent reverse flow into the pump 602.

In example operation of the pressure source 600, the pump 602 is operated and draws hydraulic fluid from fluid intake line 606. Pressurized hydraulic fluid is then conveyed to the hydraulic line 124, which feeds the pressurized hydraulic fluid to any of the pilot and power modules described herein. Displaced or spent hydraulic fluid resulting from actuation (operation) of the actuation devices described herein is then conveyed into the fluid return 216, as generally described above, which can then be drawn upon by the pump 602 once more. Accordingly, the pressure source 600 provides a closed loop system where the hydraulic fluid used to operate the actuation devices of the downhole tool (e.g., the downhole tool 116 of FIG. 1) is subsequently recycled back through the pressure source to be used again. During operation, fluid reservoir 604 provides make up hydraulic fluid 614*b* to be pumped using the pump 602 or alternatively absorbs excess hydraulic fluid when needed. At least one advantage of the pressure source 600 is that the hydraulic fluid is kept isolated from other fluids pumped into the downhole tool for other purposes, thereby avoiding potential contamination.

Computer hardware can be used to implement the various functions of the control system 120 (FIG. 1) and associated pilot and power modules described herein. Accordingly, the control system 120 can include a processor configured to execute one or more sequences of instructions, programming stances, or code stored on a non-transitory, computer-readable medium. The processor can be, for example, a general purpose microprocessor, a microcontroller, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, computer hardware can further include elements such as, for example, a memory (e.g., random access memory (RAM), flash memory, read only memory (ROM), programmable read only memory (PROM), erasable read only memory (EPROM)), registers, hard disks, removable disks, CD-ROMS, DVDs, or any other like suitable storage device or medium.

Executable sequences described herein can be implemented with one or more sequences of code contained in a memory also included in the control system 120 (FIG. 1). In some embodiments, such code can be read into the memory from another machine-readable medium. Execution of the sequences of instructions contained in the memory can cause a processor to perform the process steps described herein. One or more processors in a multi-processing arrangement can also be employed to execute instruction sequences in the memory. In addition, hard-wired circuitry can be used in place of or in combination with software instructions to implement various embodiments described herein. Thus, the present embodiments are not limited to any specific combination of hardware and/or software.

As used herein, a machine-readable medium will refer to any medium that directly or indirectly provides instructions to a processor for execution. A machine-readable medium can take on many forms including, for example, non-volatile media, volatile media, and transmission media. Non-volatile media can include, for example, optical and magnetic disks. Volatile media can include, for example, dynamic memory. Transmission media can include, for example, coaxial cables, wire, fiber optics, and wires that form a bus. Common forms of machine-readable media can include, for example, floppy disks, flexible disks, hard disks, magnetic tapes, other like magnetic media, CD-ROMs, DVDs, other like optical media, punch cards, paper tapes and like physical media with patterned holes, RAM, ROM, PROM, EPROM, and flash EPROM.

Embodiments disclosed herein include:

A. A control system that regulates a flow of hydraulic fluid to an actuation device operable to actuate a downhole tool, the control system including: a pilot module having a first electrically operated valve fluidly coupled to a first hydraulic input, a pressure source, and a fluid return and a second electrically operated valve fluidly coupled to a second hydraulic input, the pressure source, and the fluid return; and a power module fluidly coupled to the actuation device at an output line and including a power line in fluid communication with the output line, a first power module check valve arranged in the power line, and at least one directional control valve actuatable in response to a pilot signal to drain hydraulic fluid from the power module into the fluid return via a control pressure return line.

B. A well system, including: a conveyance extendable into a wellbore from a well surface location; a downhole tool coupled to the conveyance and conveyable into the wellbore, the downhole tool including a hydraulically operated actuation device; and a control system that regulates a flow of hydraulic fluid to the actuation device, the control system including: a pilot module having a first electrically operated valve fluidly coupled to a first hydraulic input, a pressure source, and a fluid return and a second electrically operated valve fluidly coupled to a second hydraulic input, the pressure source, and the fluid return; and a power module fluidly coupled to the actuation device at an output line and including a power line in fluid communication with the output line, a first power module check valve arranged in the power line, and at least one directional control valve actuatable in response to a pilot signal to drain hydraulic fluid from the power module into the fluid return via a control pressure return line.

C. A control system that regulates a flow of hydraulic fluid to an actuation device operable to actuate a downhole tool, the control system including: a first electrically operated valve fluidly arranged in a pressure supply line and fluidly coupled to a pressure source and an output, wherein the output is fluidly coupled to the actuation device and activation of the first electrically operated valve provides hydraulic fluid directly to the actuation device; a second electrically operated valve arranged in a pressure return line and fluidly coupled to a fluid return and the output, wherein activation of the second electrically operated valve allows fluid drainage from the actuation device via the output; a first pilot module check valve arranged in a pressure supply line downstream from the first electrically operated valve; and a second pilot module check valve arranged in the pressure return line downstream from the second electrically operated valve.

Each of embodiments A, B, and C may have one or more of the following additional elements in any combination:

Element 1: the pilot module further has a pilot module check valve arranged in a pressure return line to isolate the pilot module from fluid pressure in the fluid return.

Element 2: the power module further includes a second power module check valve arranged in the control pressure return line fluidly coupled to the fluid return.

Element 3: the first and second electrically operated valves are each positionable such that internal high-pressure leakage from the pressure source drains directly to the fluid return.

Element 4: the power line extends from the first hydraulic input to the output line and the first electrically operated valve is activated to convey hydraulic fluid from the pressure source through the first electrically operated valve and directly to the actuation device via the first hydraulic input and the output line.

Element 5: the at least one directional control valve is arranged in the control pressure return line and fluidly communicates with the second hydraulic input via a pilot line extending between the second hydraulic input and the control pressure return line, and the second electrically operated valve is activated to transmit the pilot signal to the at least one directional control valve.

Element 6: the output line is a first output line and the power line is a first power line, the power module further including: a second output line that extends from the actuation device; a second power line that extends from the second hydraulic input and connects to the second output line to fluidly couple the power module to actuation device, the second electrically operated valve being activated to convey hydraulic fluid through the second electrically operated valve and directly to the actuation device via the second power line and the second output line; and a third power module check valve arranged in the second power line to prevent hydraulic fluid from flowing back into the second hydraulic input.

Element 7: the pilot line is a first pilot line extending from the first power line, the pilot signal is a first pilot signal, and the at least one directional control valve is a first pilot-operated check valve, the power module further including: a bypass line extending between the second power line and the control pressure return line, wherein the first pilot-operated check valve is arranged in the bypass line at an end of the first pilot line and the first electrically operated valve is activated to transmit the first pilot signal to the first pilot-operated check valve; a second pilot line extending from the second power line to the control pressure return line; and a second pilot-operated check valve arranged in the control pressure return line at an end of the second pilot line, wherein the second electrically operated valve is activated to transmit a second pilot signal to the second pilot-operated check valve.

Element 8: the pilot signal is a first pilot signal, the power line extends from the pressure source to the output line, and the at least one directional control valve is a first pilot-operated check valve arranged in the control pressure return line, the power module further including a first pilot line extending from the second hydraulic input to the control pressure return line, wherein the second electrically operated valve is activated to transmit the first pilot signal to the first pilot-operated check valve; a second pilot line extending from the first hydraulic input to the power line; and a second pilot-operated check valve arranged in the power line at an end of the second pilot line, wherein the first electrically operated valve is activated to transmit a second pilot signal to the second pilot-operated check valve, which allows hydraulic fluid to flow to the actuation device via the power line and the output line.

Element 9: the output line is a first output line and the power line is a first power line, the power module further including: a second output line that extends from the actuation device; a second power line that extends from the second hydraulic input and connects to the second output line to fluidly couple the power module to actuation device; a bypass line extending between the second power line and the control pressure return line; a third pilot-operated check valve arranged in the bypass line and in fluid communication with the first hydraulic input via a branch of the second pilot line; and a fourth pilot-operated check valve arranged in the second power line and in fluid communication with the second hydraulic input via a branch of the first pilot line, wherein transmission of the second pilot signal from the second pilot-operated check valve opens the second and third pilot-operated check valves, and transmission of the first pilot signal from the first pilot-operated check valve opens the first and fourth pilot-operated check valves.

Element 10: the output line is a first output line and the power line is a first power line, the power module further including: a second output line that extends from the actuation device; a second power line that extends from the second hydraulic input and connects to the second output line to fluidly couple the power module to actuation device; a bypass line extending between the second power line and the control pressure return line; a third pilot-operated check valve arranged in the bypass line and in fluid communication with the first hydraulic input via a branch of the second pilot line; and a fourth pilot-operated check valve arranged in the second power line and in fluid communication with the second hydraulic input via a branch of the first pilot line, wherein transmission of the second pilot signal from the second pilot-operated check valve opens the second and third pilot-operated check valves, and transmission of the first pilot signal from the first pilot-operated check valve opens the first and fourth pilot-operated check valves.

Element 11: the pressure source comprises a system comprising: a pump coupled to the downhole tool and fluidly coupled to a fluid supply via a fluid intake line and fluidly coupled to a hydraulic line via a fluid discharge line; and a fluid reservoir fluidly coupled to the pump via the fluid intake line, the fluid reservoir providing a tank to hold and supply fluid to the pump and a piston movably arranged within the tank, wherein the tank is charged with a fluid on a first side of the piston and hydraulic fluid fills the tank on a second side of the piston, and wherein the pump draws hydraulic fluid from the fluid intake line and conveys pressurized hydraulic fluid to the hydraulic line to be used by the control system, and the fluid reservoir provides make up hydraulic fluid or absorbs excess hydraulic fluid.

Element 12: the first electrically operated valve is a three-way solenoid valve and the second electrically operated valve is a two-way solenoid valve, and wherein the first electrically operated valve is further fluidly coupled to the pressure return line.

Element 13: the directional control valve can include one or more of a 2-way, 3-way and/or 4-way pilot operated spool or logic valve.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A control system that regulates a flow of hydraulic fluid to an actuation device operable to actuate a downhole tool, the control system comprising:

a pilot module having a first electrically operated valve fluidly coupled to a first hydraulic input, a pressure source, and a fluid return and a second electrically operated valve fluidly coupled to a second hydraulic input, the pressure source, and the fluid return; and a power module fluidly coupled to the actuation device at an output line, the power module comprising:

a power line in fluid communication with the output line, wherein the power line extends from the first hydraulic input to the output line and the first electrically operated valve is activated to convey hydraulic fluid from the pressure source through the first electrically operated valve and directly to the actuation device via the first hydraulic input, the power line, and the output line;

a first power module check valve arranged in the power line; and at least one pilot operated check valve actuatable in response to a pilot signal to drain hydraulic fluid from the power module into the fluid return via a control pressure return line, wherein the control pressure return line is in fluid communication with the power line and the output line, where the at least one pilot operated check valve is arranged in the control pressure return line and fluidly communicates with the second hydraulic input via a pilot line extending between the second hydraulic input and control pressure return line, and wherein the second electrically operated valve is activated to transmit the pilot signal to the at least one pilot-operated check valve.

2. The control system of claim 1, wherein the pilot module further has a pilot module check valve arranged in a pressure return line to isolate the pilot module from fluid pressure in the fluid return.

3. The control system of claim 1, wherein the power module further includes a second power module check valve arranged in the control pressure return line fluidly coupled to the fluid return.

4. The control system of claim 1, wherein the first and second electrically operated valves are each positionable such that internal high-pressure leakage from the pressure source drains directly to the fluid return.

5. The control system of claim 1, wherein the output line is a first output line and the power line is a first power line, the power module further including:

a second output line that extends from the actuation device;

a second power line that extends from the second hydraulic input and connects to the second output line to fluidly couple the power module to actuation device, the second electrically operated valve being activated to convey hydraulic fluid through the second electrically operated valve and directly to the actuation device via the second power line and the second output line; and a third power module check valve arranged in the second power line to prevent hydraulic fluid from flowing back into the second hydraulic input.

6. The control system of claim 5, wherein the pilot line is a first pilot line extending from the first power line, the pilot signal is a first pilot signal, and the at least one directional control valve is a first pilot-operated check valve, the power module further including:

a bypass line extending between the second power line and the control pressure return line, wherein the first pilot-operated check valve is arranged in the bypass line at an end of the first pilot line and the first electrically operated valve is activated to transmit the first pilot signal to the first pilot-operated check valve;

a second pilot line extending from the second power line to the control pressure return line; and a second pilot-operated check valve arranged in the control pressure return line at an end of the second pilot line, wherein the second electrically operated valve is activated to transmit a second pilot signal to the second pilot-operated check valve.

7. The control system of claim 1, wherein the pilot signal is a first pilot signal, the power line extends from the pressure source to the output line, and the at least one directional control valve is a first pilot-operated check valve arranged in the control pressure return line, the power module further including:

a first pilot line extending from the second hydraulic input to the control pressure return line, wherein the second electrically operated valve is activated to transmit the first pilot signal to the first pilot-operated check valve;

a second pilot line extending front the first hydraulic input to the power line; and a second pilot-operated check valve arranged in the power line at an end of the second pilot line, wherein the first electrically operated valve is activated to transmit a second pilot signal to the second pilot-operated check valve, which allows hydraulic fluid to flow to the actuation device via the power line and the output line.

8. The control system of claim 7, wherein the output line is a first output line and the power line is a first power line, the power module further including:

a second output line that extends from the actuation device;

a second power line that extends from the second hydraulic input and connects to the second output line to fluidly couple the power module to actuation device;

a bypass line extending between the second power line and the control pressure return line;

a third pilot-operated check valve arranged in the bypass line and in fluid communication with the first hydraulic input via a branch of the second pilot line; and a fourth pilot-operated check valve arranged in the second power line and in fluid communication with the second hydraulic input via a branch of the first pilot line, wherein transmission of the second pilot signal from the second pilot-operated check valve opens the second and third pilot-operated check valves, and transmission of the first pilot signal from the first pilot-operated check valve opens the first and fourth pilot-operated check valves.

9. The control system of claim 1, wherein the pressure source comprises a system comprising:

a pump coupled to the downhole tool and fluidly coupled to a fluid supply via a fluid intake line and fluidly coupled to hydraulic line via a fluid discharge line; and a fluid reservoir fluidly coupled to the pump via the fluid intake line, the fluid reservoir providing a tank to hold and supply fluid to the pump and a piston movably arranged within the tank, wherein the tank is charged with a fluid on a first side of the piston and hydraulic fluid fills the tank on a second side of the piston, and wherein the pump draws hydraulic fluid from the fluid intake line and conveys pressurized hydraulic fluid to the hydraulic line to be used by the control system, and the fluid reservoir provides make up hydraulic fluid or absorbs excess hydraulic fluid.

10. A well system, comprising:

a conveyance extendable into a wellbore from a well surface location;

a downhole tool coupled to the conveyance and conveyable into the wellbore, the downhole tool including a hydraulically operated actuation device; and a control system that regulates a flow of hydraulic fluid to the actuation device, the control system including:

a pilot module having a first electrically operated valve fluidly coupled to a first hydraulic input, a pressure source, and a fluid return and a second electrically operated valve fluidly coupled to a second hydraulic input, the pressure source, and the fluid return; and a power module fluidly coupled to the actuation device at an output line and including a power line in fluid communication with the output line, a first power module check valve arranged in the power line, and at least one directional control valve actuatable in response to a pilot signal to drain hydraulic fluid from the power module into the fluid return via a control pressure return line, and wherein the pilot signal is a first pilot signal, the power line extends from the pressure source to the output line, and the at lest one directional control valve is a first pilot-operated check valve arranged in the control pressure line, the power module further including:

a first pilot line extending from the second hydraulic input to the control pressure return line, wherein the second electrically operated valve is activated to transmit the first pilot signal to the first pilot-operated check valve;

a second pilot line extending from the first hydraulic input to the power line; and a second pilot-operated check valve arranged in the power line at an end of the second pilot line, wherein the first electrically operated valve is activated to transmit a second pilot signal to the second pilot-operated check valve, which allows hydraulic fluid to flow to the actuation device via the power line and the output line.

11. The well system of claim 10, wherein the power module further includes a second power module check valve arranged in the control pressure return line.

12. The system of claim 10, further comprising:

a control line extendable from the well surface location to the downhole tool, wherein the control line communicates with the control system to trigger activation of the first and second electrically operated valves; and a hydraulic line extendable from the well surface location to the downhole tool to deliver pressurized fluid to the first and second electrically operated valves.

13. The well system of claim 10, wherein the power line extends from the first hydraulic input to the output line and the first electrically operated valve is activated to convey hydraulic fluid from the pressure source through the first electrically operated valve and directly to the actuation device via the first hydraulic input and the output line.

14. The well system of claim 10, wherein the output line is a first output line and the power line is a first power line, the power module further including:

a second output line that extends from the actuation device;

a second power line that extends from the second hydraulic input and connects to the second output line to fluidly couple the power module to actuation device;

a bypass line extending between the second power line and the control pressure return line;

a third pilot-operated check valve arranged in the bypass line and in fluid communication with the first hydraulic input via a branch of the second pilot line; and a fourth pilot-operated check valve arranged in the second power line and in fluid communication with the second hydraulic input via a branch of the first pilot line, wherein transmission of the second pilot signal from the second pilot-operated check valve opens the second and third pilot-operated check valves, and transmission of the first pilot signal from the first pilot-operated check valve opens the first and fourth pilot-operated check valves.

15. The well system of claim 10, wherein the pressure source comprises closed loop system comprising:

a pump coupled to the downhole tool and fluidly coupled to a fluid supply via a fluid intake line and fluidly coupled to a hydraulic line via a fluid discharge line; and an accumulator fluidly coupled to the pump via the fluid intake line, the accumulator providing a tank and a piston movably arranged within the tank, wherein the tank is charged with a fluid on a first side of the piston and hydraulic fluid fills the tank on a second side of the piston, and wherein the pump draws hydraulic fluid from the fluid intake line and conveys pressurized hydraulic fluid to the hydraulic line to be used by the control system, and the accumulator provides make up hydraulic fluid or absorbs excess hydraulic fluid.

16. A control system that regulates a flow of hydraulic fluid to an actuation device operable to actuate a downhole tool, the control system comprising:

a first electrically operated valve fluidly arranged in a pressure supply line and fluidly coupled to a pressure source and an output, wherein the output is fluidly coupled to the actuation device and activation of the first electrically operated valve provides hydraulic fluid directly to the actuation device;

a second electrically operated valve arranged in a pressure return and fluidly coupled to a fluid return and the output, wherein activation of the second electrically operated valve allows fluid drainage from the actuation device via the output;

a first pilot module check valve arranged in a pressure supply line downstream from the first electrically operated valve; and a second pilot module check valve arranged in the pressure return line downstream from the second electrically operated valve.

17. The downhole tool of claim 16, wherein the first electrically operated valve is a three-way solenoid valve and the second electrically operated valve is a two-way solenoid valve, and wherein the first electrically operated valve is further coupled to the pressure return line.

* * * * *